US006789756B2

(12) United States Patent
Beliavsky

(10) Patent No.: US 6,789,756 B2
(45) Date of Patent: Sep. 14, 2004

(54) VORTEX MILL FOR CONTROLLED MILLING OF PARTICULATE SOLIDS

(75) Inventor: Yan Beliavsky, Maalot (IL)

(73) Assignee: Super Fine Ltd., Yokneam (IL)

( * ) Notice: Subject to any disclaimer, the term of this patent is extended or adjusted under 35 U.S.C. 154(b) by 30 days.

(21) Appl. No.: 10/080,216

(22) Filed: Feb. 20, 2002

(65) Prior Publication Data

US 2003/0155454 A1 Aug. 21, 2003

(51) Int. Cl.[7] ..... B02C 19/06
(52) U.S. Cl. ..... 241/5; 241/39; 241/97; 241/80
(58) Field of Search ..... 241/5, 39, 40, 241/80, 97

(56) References Cited

U.S. PATENT DOCUMENTS

| | | | | |
|---|---|---|---|---|
| 3,608,835 A | * | 9/1971 | Ruzicka | 241/4 |
| 3,688,991 A | * | 9/1972 | Norwood | 241/5 |
| 3,726,484 A | * | 4/1973 | Schurr | 241/5 |
| 4,189,102 A | | 2/1980 | Andrews | |
| 4,219,164 A | | 8/1980 | Taylor | |
| 4,502,641 A | | 3/1985 | Coombe | |
| 4,546,926 A | | 10/1985 | Niemi | |
| 4,664,319 A | | 5/1987 | Andrews | |
| 5,133,504 A | | 7/1992 | Smith et al. | |
| 5,855,326 A | | 1/1999 | Beliavsky | |

FOREIGN PATENT DOCUMENTS

| | | |
|---|---|---|
| SU | 1457995 | 2/1989 |
| WO | WO 94/08719 | 4/1994 |
| WO | WO 98/52694 | 11/1998 |

* cited by examiner

*Primary Examiner*—Mark Rosenbaum
(74) *Attorney, Agent, or Firm*—Lilling & Lilling

(57) ABSTRACT

An improved vortex mill for milling a substantially particulate solid material, which includes one or more working chambers. The mill also includes one or more working fluid inlets and one or more discharge ports. One or more working fluid inlets together with one or more discharge ports facilitate the vortex flow within the one or more working chambers. There are also one or more feed inlets to provide milling of the solid material, which is discharged from one or more discharge ports. In addition, there is apparatus for inducing controlled perturbations in the flow of the working fluid in the one or more working chambers, thereby to improve the milling of the solid material in the vortex flow.

67 Claims, 19 Drawing Sheets

VORTEX MILL FOR CONTROLLED MILLING OF PARTICULATE SOLIDS

FIELD OF THE INVENTION

The present invention relates to the milling of solids by use of vortex mills, generally, and more specifically, to the controlled milling of solids thereby.

BACKGROUND OF THE INVENTION

It is known in the art to provide a means for the comminution of particulate solids. Many different milling devices are known. These include, for example, grinding mills, ball mills, rod mills, impact mills, jet mills and vortex mills. With the exception of the jet and vortex mill, in order to obtain particle comminution, most mills rely on an interaction between the particulate solid and another surface, such as the balls in a ball mill, or a baffle or impact surface in an impact mill. Jet and vortex mills do not rely, for their effectiveness, on interaction with other surfaces for particle disintegration. In addition, mills generally provide a milled product having a broad range of particle sizes, including significant proportions of oversized and undersized particles. Specifically, most mills are relatively difficult to control in so far as accurately predetermining a desired final particle size or, more particularly, a specific range of particle sizes. Furthermore, avoidance of excessive proportions of either oversize or under-size particles is often problematic.

In the art a distinction is made between jet pulverizing systems or jet mills and whirl or vortex chamber mills. Generally, in jet mills, particulate solids to be milled are introduced into a chamber where the working fluid is accelerated to high speed using venturi nozzles. Moving at a high speed, particles collide with a target such as a deflecting surface or with other moving particles in the chamber. Specifically, in jet mills particles are milled as a consequence of a collision effect. Operating speeds of particles in jet mills are generally not less than 150–300 m/s. Such jet mills are described for example in U.S. Pat. No. 5,133,504. In other jet mills, introduced coarse particles collide with intersecting high speed fluid jets, to achieve a higher collision speed, as described for example in U.S. Pat. No. 4,546,926. However, in all such jet mills, the problem of producing a range of particle sizes and of controlling the extent of comminution is not fully solved, in so far as the elimination or reduction of production of undesirable, excessive, undersized particles is concerned. Furthermore, such production of undersized particles represents an increase in energy consumption.

Use has been made of whirl or vortex chambers in conjunction with jet mills for the classification or sorting of the ground material emerging from jet milling. In such combined systems the relatively coarse particles are recirculated from the whirling classifier back into the jet mill. Such systems are described, for example, in U.S. Pat. No. 4,219,164, U.S. Pat. No. 4,189,102 and U.S. Pat. No. 4,664,319. In such systems, however, vortex chambers do not effect the milling operation, but rather particle size classification.

Another development of this technology is referred to, for example, in U.S. Pat. No. 4,502,641, which constitutes a combination of jet milling with a vortex chamber. Material to be milled is introduced through a venturi nozzle into a vortex chamber at a speed of about 300 m/s. There is created, in the vortex chamber, a fluid vortex rotating at a substantially lower speed. In the course of the milling process, particles injected into the chamber rotate in the relatively slow fluid vortex and become targets for further high speed particles injected through the venturi nozzle. Collision between particles moving in the vortex and particles introduced through the venturi nozzle, results in impact comminution as in the case of jet-mills mentioned heretofore.

There are further known in the art, vortex chambers which perform so-called resonance whirl or vortex milling. This milling process differs significantly from jet milling. For example, the particle speed in whirl chambers is considerably lower than that in jet mills and the high-speed injection of feed particles into jet mills is unnecessary in vortex mills. Fluid speed through the nozzles of a vortex chamber is generally in the range 50–130 m/s, and particle rotational speed in the vortex chamber no more than 50 m/s. At such low speeds, jet mills become ineffective. Referring to WO 94/08719, WO 98/52694 and SU 1,457,995, there are described whirl or vortex chamber milling devices, fitted with tangential fluid injection nozzles, which carry out "resonance vortex grinding". The working chamber includes a generally cylindrical body with one or more openings for the introduction of particulate solids. During the milling process, particles reaching the required particle size range are continuously discharged via an axial discharge duct. Further, there may be provided sound generators in the inlet fluid nozzles for interacting with the incoming fluid flow and thereby enhancing the grinding operation as described in WO 94/08719. Additionally, the chamber may be provided with a rotatable internal side-wall adapted for rotation in the direction opposite to the direction of rotation of the vortex as described in SU 1,457,995.

U.S. Pat. No. 5,855,326 to Beliavsky, the present inventor, entitled "Process And Device For Controlled Comminution Of Materials In A Whirl Chamber," describes a process for the controlled comminution of particulate solid material. The process includes the tangential injection of a working fluid into a working chamber, and the introduction thereinto of particulate solid material. A vortex is created in the chamber and the particulate material undergoes comminution. Control of the milling and the particle size is achieved by accelerating or retarding discharge of the particles from the chamber and by the interaction of particles with mechanical elements provided in the chamber. Particles are caused to move in a random manner in all directions within the vortex and to be retained within the vortex by such mechanical elements. There is further described a cylindrical whirl chamber having an inlet into the chamber for working fluid, means for introducing particulate solid material, a discharge nozzle, and one or more mechanical elements for control of the comminution process.

It is desirable to improve and increase the amount of control in respect of the milling process, particularly with regard to the extent of comminution, to the rate of comminution, to energy conservation and to predetermined particle size.

NOTES

In the description of the present invention, terms such as "top", "bottom", "upper", "lower", "height" and "side" are utilized for convenience of description and are not necessarily intended to indicate an orientation in space.

SUMMARY OF THE INVENTION

The present invention aims to provide an improved controlled comminution of solids relative to known art.

There is thus provided in accordance with a preferred embodiment of the present invention an improved vortex mill for milling a substantially particulate solid material. The mill includes one or more working chambers having a side-wall defining a generally cylindrical, inward facing surface and a first and a second end wall arranged transversely to the side-wall. The end surfaces are formed contiguously with and transversely to the inward-facing surface, thereby to define therewith each of one or more working chambers.

The mill also includes one or more working fluid inlets for introducing a generally tangential flow of working fluid into the one or more working chamber thereby to create a vortex flow therein. One or more discharge ports are formed in one or more of the end walls, for permitting discharge of working fluid and milled material from the one or more working chambers. One or more working fluid inlets together with one or more discharge ports facilitate the vortex flow within the one or more working chambers For introducing a substantially particulate solid material into the one or more working chambers so as to be taken up in a vortex flow of the working fluid, there are one or more feed inlets, thereby to provide milling of the solid material which is discharged from one or more discharge ports.

In addition, there is apparatus for inducing controlled perturbations in the flow of the working fluid in the one or more working chambers, thereby to improve the milling of the solid material in the vortex flow.

There is also provided, in accordance with another preferred embodiment of the present invention, an improved vortex mill including an outer casing configured to surround and enclose one or more working chambers so as to be spaced therefrom and thereby to define therewith an outer fluid flow volume. The outer casing also includes one or more outer working fluid inlets for introducing a flow of working fluid into the outer fluid flow volume, thereby to induce a fluid flow therein, operative to discharge through an inner working fluid inlet into the one or more working chambers.

Furthermore, the outer casing includes one or more outer feed inlets for introducing substantially particulate solid material into one or more working chambers via one or more inner feed inlets. In addition, there are one or more outer discharge ports for permitting discharge of milled particulate solid material from the one or more working chambers via the inner discharge port.

According to a variation of a preferred embodiment of the present invention, the side-wall of the at least one working chamber is formed of at least one functional insert generally coaxially disposed within the working chamber and having a closed shape. Each of the one or more functional inserts have a generally cylindrical side-wall formed therein.

Additionally, one or more functional inserts include at least a first and a second functional insert having substantially similar configurations and a substantially similar angular orientation with respect to each other. Alternatively, one or more functional inserts include at least a first and a second functional insert having substantially dissimilar configurations with respect to each other. The dissimilar functional inserts are disposed in a predetermined configuration sequence within the working chamber. The dissimilar functional inserts, are dissimilar with respect to: diameter, height, shape of said inward facing surface, or mechanical insert elements.

In accordance with an additional embodiment of the present invention, one or more working chambers include one ore more flow restriction elements having one or more orifice formed therein. Each orifice is formed having a predetermined size, orientation and disposition, Each flow restriction element is mounted in a fixed, coaxial disposition relative to one or more functional inserts, thereby to increase dwell time of the particulate solid material to be milled therewithin. Flow restriction elements have a configuration of: flat, planar, conical, frustum, convex, polyhedral, dished, or a surface generated by rotation of a line about the axis of said chamber in accordance with a predetermined geometric function. Furthermore a flow restriction element has one coaxial orifice formed therein.

Also, a flow restriction element may be formed integrally with one or more working chambers or is non-fixably supported within a working chamber. Alternatively, a flow restriction element is fixably mounted between a first functional insert and a second functional insert, thereby to control comminution of solid material.

Also, according to a variation of an embodiment of the present invention, a flow restriction element has vanes disposed thereon, thereby to deflect solid particles within the vortex flow generally away from the inward facing surface of the side-wall and generally towards the vortex axis. Alternatively, the vanes are disposed thereon, thereby to deflect solid particles within the vortex flow generally away from the vortex axis and towards the inward facing surface of the side-wall.

Also, in accordance with further variations of embodiments of the present invention, the flow restriction element includes having one or more rib-shaped baffle fixably attached thereto. Each rib-shaped baffle is concentric with the cylindrical side-wall and serves to reduce the velocity of solid particles adjacent to the flow restriction element thereby to prevent premature discharge of the solid particles.

Additionally, in accordance with a preferred embodiment of the present invention, the apparatus for inducing predetermined perturbations includes a side-wall configuration which includes a plurality of substantially planar side-walls. The apparatus possibly also includes one or more working fluid inlets formed within a formed recess located between adjacent substantially planar side-walls, the inlet being disposed substantially parallel to the substantially planar side-walls and generally tangentially with respect to the working chamber. Furthermore, the apparatus possibly includes one or more auxiliary working fluid inlets formed within one or more of the plurality of substantially planar side-walls. The auxiliary working fluid inlets are disposed substantially non-parallel to the substantially planar side-walls with respect to the working chamber. The one or more auxiliary working fluid inlets are provided to introduce auxiliary working fluid flow into the working chamber, thereby to cause controlled perturbations in the vortex flow and also thereby to redirect flow of particles away from the planar side-wall across the vortex flow. Another side-wall configuration includes at least one substantially planar side-wall formed within the generally cylindrical inward facing surface.

Alternatively, one or more auxiliary working fluid inlets are formed in the side-wall, and are directed substantially non-tangentially to the side-wall and at a predetermined angle to the direction of vortex flow at a point of entry of working fluid. Thereby, additional working fluid flow is introduced generally non tangentially into the working chamber, thereby to create controlled perturbations in the vortex flow and also to redirect the flow of particles away from the side-wall across the vortex flow. Another alternative relates to one or more mechanical insert elements disposed on the inward-facing surface, parallel to the axis of the working chamber. The mechanical insert element has a curved surface so as to be generally disposed away from the inward facing surface and towards the working chamber axis. In this way, the flow of working fluid and particles of solid material is redirected away from the inward facing surface, and predetermined perturbations are induced in the flow of working fluid.

A further alternative provides that one or more auxiliary working fluid inlets are disposed in the inward-facing surface. The one or more auxiliary working fluid inlets are associated with the one or more mechanical insert elements. Thereby, the flow of working fluid and particles of solid material are redirected away from the inward facing surface and induce predetermined perturbations in the flow of working fluid. One other alternative is the disposition a mechanical elastic oscillation generator on the inward facing surface, to induce predetermined perturbations in the flow of working fluid, In accordance with a further embodiment of the present invention, the apparatus for inducing predetermined perturbations in the flow of the working fluid includes apparatus for controlling the entry flow rate of working fluid, the rate of introduction of substantially particulate solid material into the working chamber, for varying the working fluid pressure in the working chamber and the rate of discharge of particulate solid material. Moreover, the apparatus for inducing controlled perturbations in the flow of the working fluid is operative to limit the frequency to within the range 5 Hz to $5.10^4$ kHz.

In accordance with another embodiment of the present invention, each of the end walls has a shape that is either flat, planar, conical, frustum, convex, polyhedral, dished or has a surface generated by rotation of a line about the axis of the chamber in accordance with a predetermined geometric function.

Additionally, a relationship between diameter and height of the inward facing surface of the generally cylindrical side-wall, in accordance with one other embodiment of the present invention, is defined in accordance with a predetermined geometrical expression, more specifically $H<2.5D$, in which D is the diameter of the generally cylindrical side-wall inward facing surface and H is the height thereof.

In accordance with other embodiments of the present invention the one or more feed inlets are disposed in the end wall, orientated, co-axially with the working chamber, co-axially with the discharge port or eccentrically to the axis thereof. Alternatively the one or more feed inlets are disposed co-axially with the discharge port formed in the first end wall, with a distal end of the one or more feed inlets fixably attached to the inner surface of the second end wall. Then again, the one or more feed inlets are disposed in the side-wall or in the end walls.

In accordance with further embodiments of the present invention, the one or more feed inlets include a baffle apparatus generally disposed at a distal end of the feed inlet. The baffle reduces the kinetic energy of feed particles entering the working chamber through the feed inlet, and reduces feed particle velocity. Particle flow into the working chamber is thus diffused. Furthermore, the one or more feed inlets communicate with the working chamber via a transverse opening in a distal end of the feed inlet, a slot opening orientated parallel to the axis of the working chamber or orientated at a predetermined angle to the axis of the chamber. In addition, the one or more feed inlets include apparatus for introducing a flow of substantially particulate solid material into the chamber at a selected rate. This apparatus includes an ejector, the ejector drawing feed solid material from a feed vessel and, thereafter introducing a flow of substantially particulate solid material into the chamber.

In accordance with other embodiments of the present invention, the one or more discharge ports formed in one or more of the end faces is formed substantially coaxial with respect to the working chamber, and is configured to be circular or annular. Further, the configuration of the one or more discharge ports formed in one or more of the end faces is defined accordance with an expression $S_{outlet}>10^{-3}D^2$, in which $S_{outlet}$ is the cross-sectional area of the discharge port; and D is the diameter of the inward facing surface. In addition, the one or more discharge port includes apparatus for separating discharged milled particulate solid material from working fluid and apparatus for collecting discharged milled particulate solid material.

In accordance with a further embodiment of the present invention, the one or more feed inlets and the one or more discharge ports are substantially mutually co-axial.

In accordance with other embodiments of the present invention, one or more auxiliary discharge ports are formed in the cylindrical side-wall or in the end walls. These auxiliary discharge ports include means for discharging partially milled particulate solid material from the one or more auxiliary discharge port and for receiving discharged partially milled particulate material from the one or more auxiliary discharge port. Partially milled particulate material is re-introduced into one or more working chambers via a conduit and an auxiliary feed inlet. This auxiliary feed inlet may be coaxially formed with the feed inlet.

According to another embodiment of the present invention, one or more recesses are formed in either the inward facing surface of the generally cylindrical side-wall or one or more of the end walls, thereby to induce a controlled perturbation in the vortex flow.

Further, one or more recesses include one or more working fluid inlets, feed inlets for particulate solid material or discharge ports for comminuted particulate solid material formed in fluid flow communication with the recess. Alternatively, one or more recesses have at least one portion filled with a fluid permeable diffusing medium, thereby to enable dispersed ingress of working fluid into the working chamber.

In accordance with a further embodiment of the present invention, apparatus for inducing controlled perturbations in the flow of the working fluid in one or more working chambers, includes one or more mechanical elastic oscillation generators mounted in association with the inward facing surface or the end walls of one or more working chambers. Thereby, controlled perturbations are caused in the flow of the working fluid in the one or more working chambers. Further apparatus for inducing controlled perturbations in the flow of the working fluid in one or more working chambers, includes one or more generally wear resistant mechanical element freely disposed within the working chamber. The mechanical elements are caused to move within the working chamber by the vortex flow.

In accordance with further embodiments of the present invention and variations thereof, the one or more working chambers include a plurality of working chambers arranged to operate in a predetermined sequence. Each of the plurality of working chambers includes one or more discharge ports for discharging particulate solid material therefrom. Each discharge port has associated therewith apparatus for receiving discharged material therefrom, and for introducing the discharged material into the feed inlet of a predetermined succeeding working chamber of the plurality of working chambers. Also, one or more of the plurality of working chambers includes one or more auxiliary discharge ports formed in the cylindrical side-wall or in the end walls for discharging therefrom a preselected proportion of the discharged particulate solid material. Each of the one or more discharge ports has associated therewith apparatus for receiving the preselected proportion of the discharged material therefrom, and for introducing the preselected proportion of the discharged material into the feed inlet of a predetermined succeeding working chamber.

Additionally, in accordance with further embodiments of the present invention, the end surfaces of the end walls include having one or more rib-shaped baffle fixably attached thereto. Each rib-shaped baffle is concentric with the cylindrical side-wall and serves to reduce the velocity of solid particles adjacent to the end surface to prevent premature discharge of the solid particles. A plurality of concentric cylindrical rib-shaped baffles defines a plurality of concentric annular channels for reducing the velocity of solid particles adjacent to the end surface and thereby prevents premature discharge of the solid particles. The concentric annular channels may also include a plurality of auxiliary fluid inlets for introducing a flow of working fluid within each of the annular channels. These auxiliary fluid inlets are generally in the direction of rotation of the vortex flow. Thus the flow of solid material adjacent to the inner surface of the end wall is accelerated and this results in regulation of the degree of milling of the solid material.

In accordance with an alternative variation of the present invention, rib-shaped baffles are formed as a configuration selected from the group: cylindrical, conical frustum and inverted conical frustum. Further, rib-shaped baffles have predetermined openings formed therein. Alternatively, rib-shaped baffles have predetermined openings formed therein, and vanes disposed adjacent to the openings and external to the circumference of the rib-shaped baffles, thereby to deflect solid particles within the vortex flow away from the inward facing surface of the side-wall and generally towards the vortex axis. The rib-shaped baffles also have predetermined openings formed therein, and have formed thereon vanes disposed adjacent to the openings and internal to the circumference of the ribs, thereby to deflect solid particles within the vortex flow generally away from the vortex axis and towards the inward facing surface of the side-wall.

There is also provided in accordance with an alternative preferred embodiment of the present invention an improved vortex mill for milling a substantially particulate solid material. The mill includes one or more working chambers having a side-wall defining a generally cylindrical, inward facing surface and a first and a second end wall arranged transversely to the side-wall. The end surfaces are formed contiguously with and transversely to the inward-facing surface, thereby to define therewith each of one or more working chambers.

The mill also includes one or more working fluid inlets for introducing a generally tangential flow of working fluid into the one or more working chamber thereby to create a vortex flow therein. One or more discharge ports are formed in one or more of the end walls, for permitting discharge of working fluid and milled material from the one or more working chambers. One or more working fluid inlets together with one or more discharge ports facilitate the vortex flow within the one or more working chambers For introducing a substantially particulate solid material into the one or more working chambers so as to be taken up in a vortex flow of the working fluid, there are one or more feed inlets, thereby to provide milling of the solid material which is discharged from one or more discharge ports. Additionally, there are one or more mechanical insert elements disposed in the inward facing surface of the side-wall or in the end surfaces of the end walls, thereby to induce controlled perturbations in the flow of the working fluid in the one or more working chamber.

In addition, according to another embodiment of the present invention, there is apparatus for inducing controlled perturbations in the flow of the working fluid in the one or more working chambers, thereby to improve the milling of the solid material in the vortex flow.

There is additionally provided, in accordance with a preferred embodiment of the present invention, a process for milling a substantially particulate solid material using an improved vortex mill. The process includes:

introducing a generally tangential flow of working fluid into a generally cylindrical working chamber thereby to create a vortex flow therein;

feeding substantially particulate solid material sought to be milled into the working chamber such that the material is taken up in suspension in the vortex flow, thereby to apply comminution stresses to the suspended solid particles;

inducing controlled perturbations in the vortex flow, thereby to regulate the comminution stresses applied to the suspended solid particles and thus also the rate of milling thereof; and discharging milled particulate solid material together with working fluid from the working chamber.

There is further provided, in accordance with a preferred embodiment of the present invention, a process in which the step of inducing controlled perturbations includes the step of controlling the extent and frequency of the controlled perturbations of the flow of the working fluid, thereby the rate of milling of the substantially particulate solid material is controlled within the working chamber.

In accordance with other embodiments of the present invention, the process includes the additional step of introducing into the working chamber a flow of working fluid via an inlet disposed at a predetermined angle to the direction of flow of the vortex. Furthermore, the step of controlling the extent and frequency of the controlled perturbations in the flow of working fluid includes adjusting the flow rate of working fluid entering generally tangentially into the chamber. Other steps include altering the feed rate of the particulate solid material, adjusting the flow rate of the working fluid entering non-tangentially into the working chamber, at a predetermined angle to the direction of flow of the vortex; or varying the working fluid pressure in the working chamber. Also, the step of feeding substantially particulate solid material includes the step of pneumatically transporting the substantially particulate solid material into the working chamber.

Further, in accordance with variations of embodiments of the present invention, the vortex flow extending transversely through the working chamber, gives rise to an area of low pressure in the region of the axis. The process step of pneumatically transporting the substantially particulate solid material into the working chamber includes the step of exposing a feed of the material to the low pressure area in the axial region of the vortex, thereby causing material to be drawn into the chamber. Also, the step of pneumatically transporting the substantially particulate solid material into the working chamber includes the step of drawing the substantially particulate solid material into the working chamber via an auxiliary feed inlet. This step utilizes a suction effect caused by the vortex flow tangential to the auxiliary feed inlet. Furthermore, pneumatically transporting the substantially particulate solid material into the working chamber includes operating an ejector with a flow of working fluid thereby drawing the substantially particulate solid material from a feed vessel, and introducing the substantially particulate solid material and working fluid into the working chamber.

In accordance with other embodiments of the present invention, the process step of discharging particulate solid material includes the step of selectively discharging unmilled and oversized particulate solid material thereby controlling the extent of comminution in the working chamber. Also included is a step of introducing the discharged unmilled and oversized particulate solid material into the working chamber for further milling. In addition, the process step of discharging particulate solid material includes the step of discharging particulate solid material from one of a plurality of working chambers. There is also included an additional step of feeding the discharged particulate solid material into a preselected working chamber of the plurality of working chambers for milling therein.

BRIEF DESCRIPTION OF THE DRAWINGS

The present invention will be more fully understood and its features and advantages will become apparent to those skilled in the art by reference to the ensuing description, taken in conjunction with the accompanying drawings, in which.

DETAILED DESCRIPTION OF THE PRESENT INVENTION

The present invention provides an improved vortex mill apparatus which controls comminution by imposing controlled perturbations within a vortex working chamber and by controlling the amplitude and frequency of these controlled perturbations. The inventor has found that controlled perturbations occurring within the vortex provide a significant influence on the pulverization process. In accordance with the preferred embodiment of the present invention and variations thereof, increasing the controlled perturbation amplitude results both in an increase in the milling rate, in achieving a much finer product and in providing control of the particle size range. The oscillating frequency also influences the resonance characteristics of the milling process. An optimal frequency range is generally established by experiment. Values of this frequency range are characterized for each particular material, which is milled in a specific vortex chamber.

Control of the degree and rate of comminution is further facilitated, according to embodiments of the present invention, by utilizing various mechanical devices and, specifically, devices for introducing controlled perturbations or for increasing the frequency and amplitude of controlled perturbations within the working chamber. In addition, varying the flow rate of working fluid through one or more auxiliary working fluid inlets having a radial flow component, influences deflection of the vortex flow thereby creating controlled perturbations of varying amplitude and frequency into the vortex flow.

Furthermore, it is sometimes desirable to avoid comminution of particles in the feed material that are already within or smaller than the required particle size range. Producing excessive undersize particles is avoidable by providing means for pre-sorting the feed material entering the working chamber thereby to control this excessive comminution. Flow of working fluid and milled particulate solids discharging from the working chamber is made to interact with the flow of solids entering the chamber, thereby providing a limited pre-sorting of the feed material. Further, those feed particles that are undersized or within the predetermined particle size range, are carried out of the working chamber. Removal of undersized particles or particles within the predetermined particle size range prevents needless milling of these particles and, thereby, reduces production of excessive quantities of under-sized particles. This presorting removal from the feed material of undersized particles or particles within the predetermined particle size range provides an improvement in the control of the comminution process.

Figure 1:
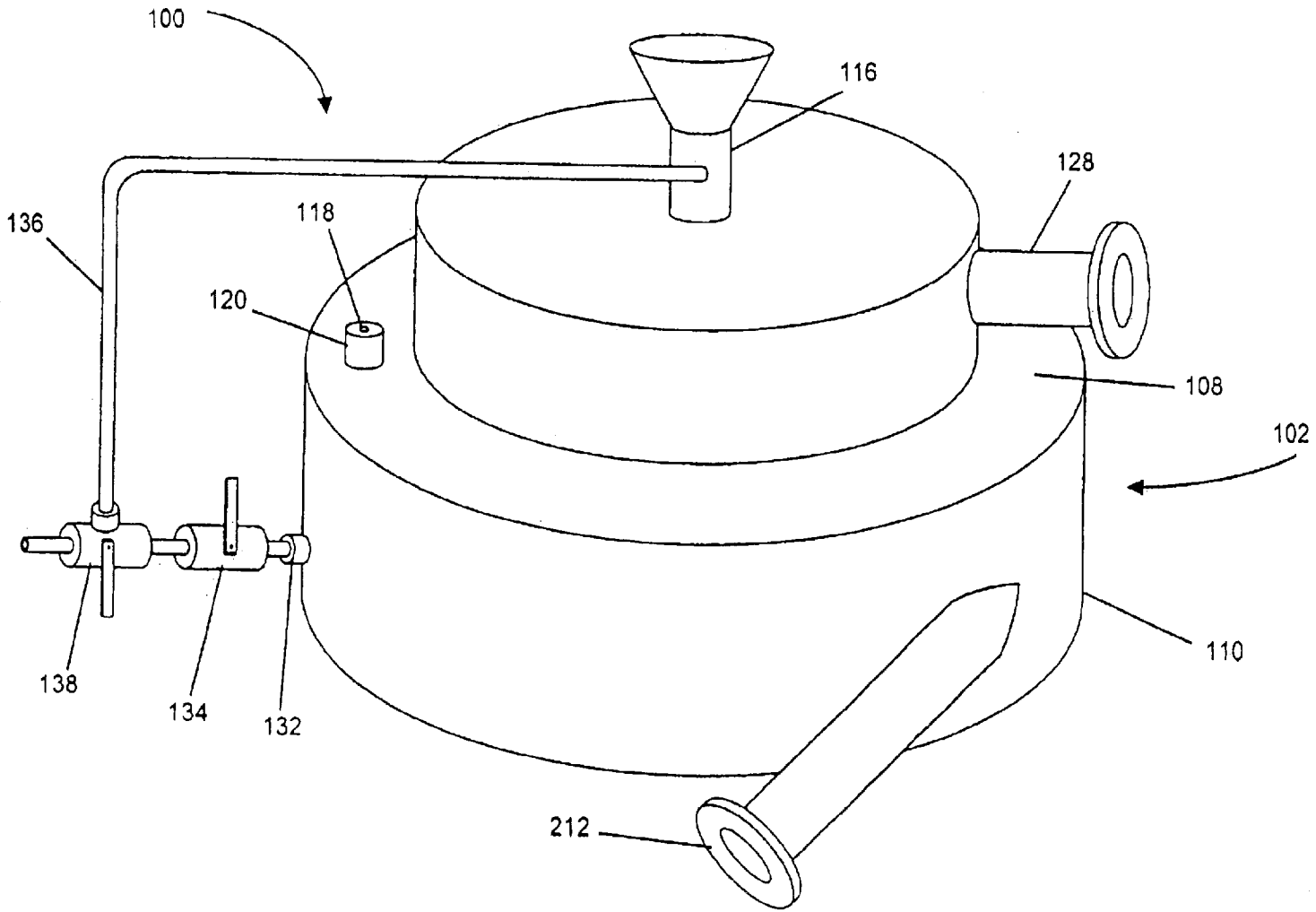
FIG. 1 illustrates a schematic isometric elevation view of a vortex mill constructed and operative in accordance with a preferred embodiment of the present invention.
Figure 2:
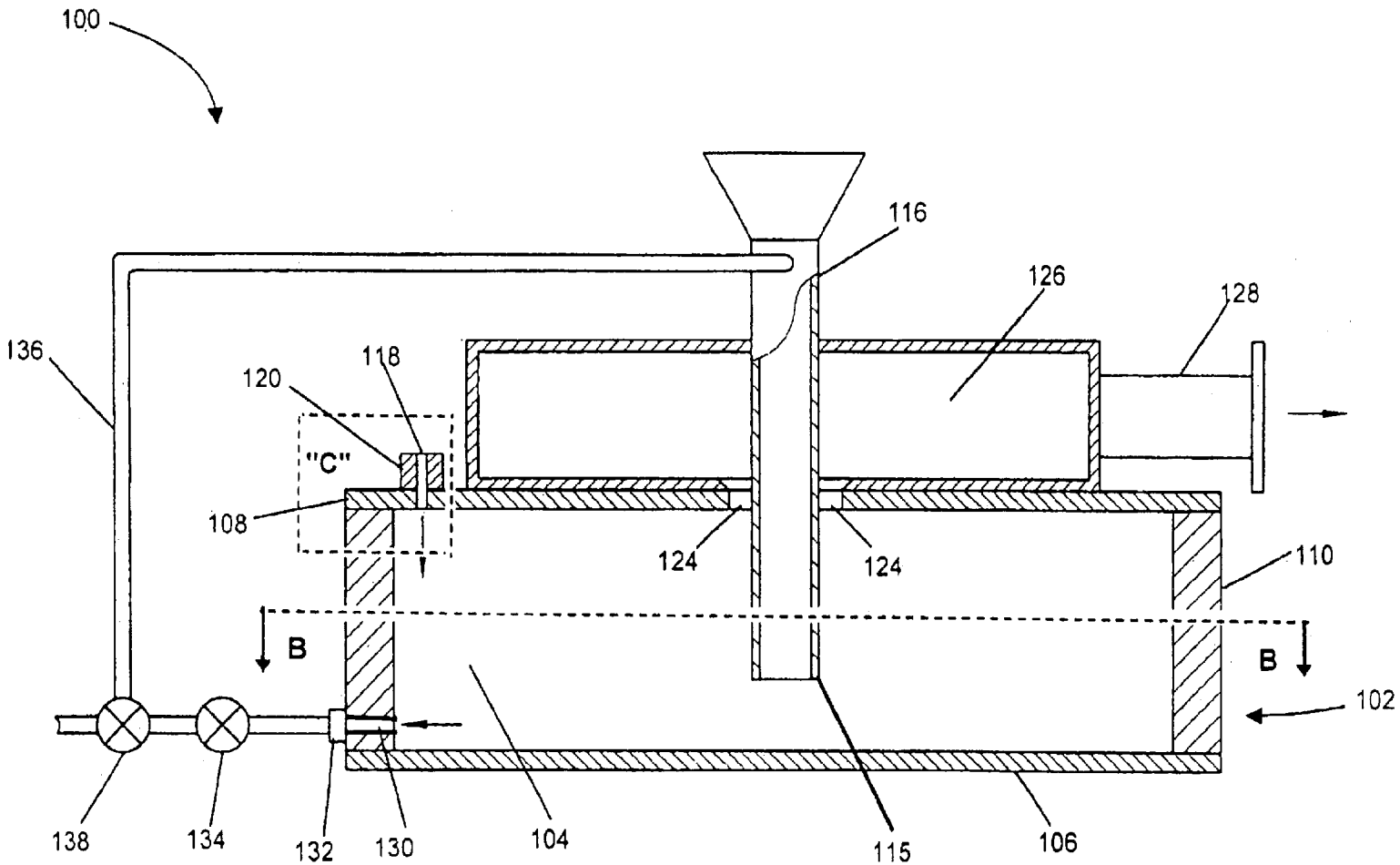
FIG. 2 illustrates a schematic axial cross-sectional view of a vortex mill, of FIG. 1 and of FIG. 3 referred to hereunder, taken along line A—A therein.
Figure 3:
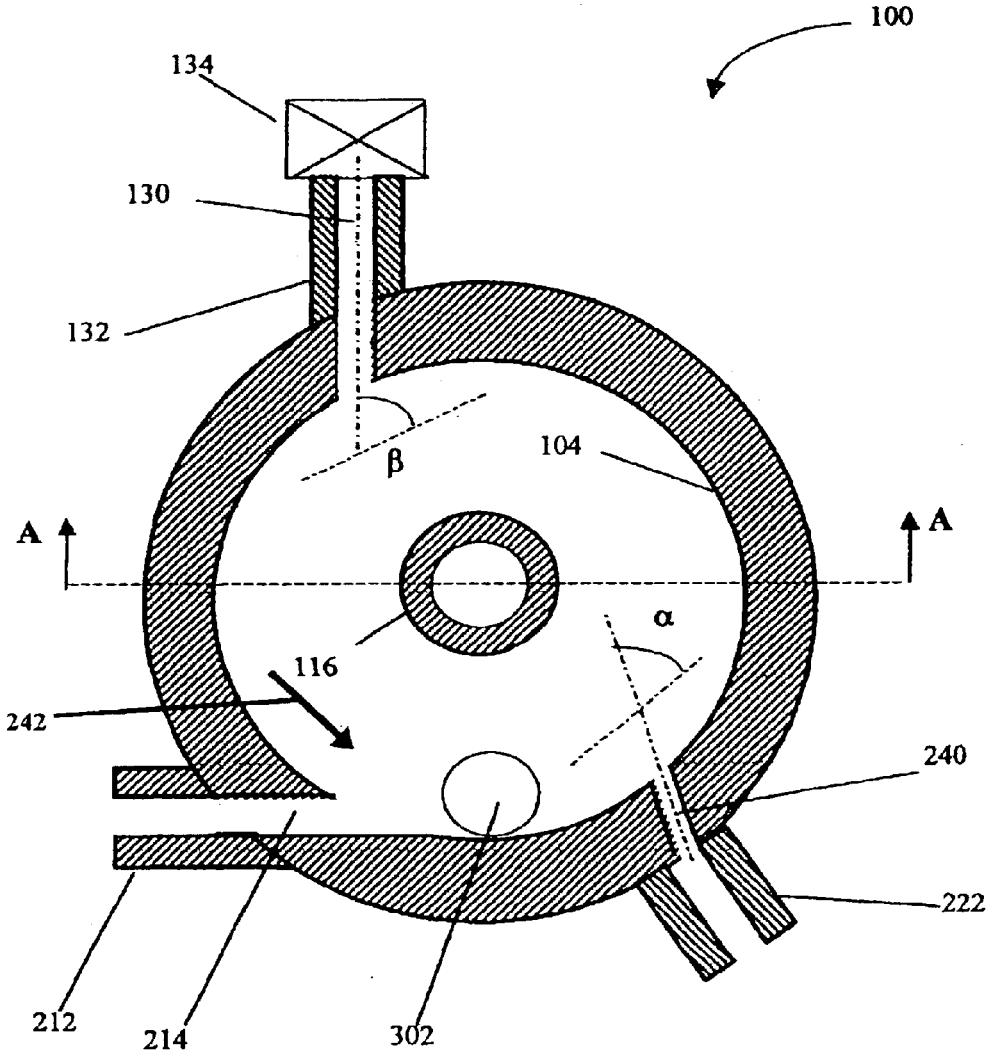
FIG. 3 illustrates a schematic radial cross-sectional view of the vortex mill of FIGS. 1 and 2, taken along line B—B therein.

Referring now to FIGS. 1, 2 and 3, there is seen a vortex mill, generally referenced 100, constructed and operative in accordance with a preferred embodiment of the present invention. Mill 100 has a cylindrical body side-wall, referenced 110, which, together with first and second end walls, respectively referenced 106 and 108 (FIG. 2), defines therewithin a working chamber, referenced generally 104. Formed tangentially in side-wall 110 is a working fluid inlet referenced 212 (FIG. 2). Working fluid inlet 212 terminates in a tangentially formed inlet nozzle referenced 214, which is generally in the form of a slot. Working fluid is introduced through inlet nozzle 214 into chamber 104 therewith to provide a vortex flow, indicated by arrow 242 (FIG. 3), within chamber 104. Fixably attached to upper wall 108 is a coaxial discharge collector referenced 126. Fixably attached co-axially to and passing through discharge collector 126 is an adjustable axial feed inlet referenced 116, extending into working chamber 104 for feeding thereto solid material to be milled. A coaxial circular discharge port 124 is formed in upper end wall 108 to permit emission into discharge collector 126 of working fluid and comminuted solids. Discharge port 124 is thereby formed as an annular opening, having axial feed inlet 116 extending therethrough. Outlet 128 of discharge collector 126, allows for discharge of working fluid and milled particles. An auxiliary solid material feed inlet, referenced 120 (FIG. 2) may be formed in upper end wall 108 with an inlet nozzle, referenced 118. An auxiliary working fluid inlet, referenced 222 (FIG. 3) with an inlet nozzle, referenced 240 may be formed in side-wall 110, at an angle $\alpha$ to the tangential direction of flow of the vortex, at the point of entry, thereby to cause perturbations in the vortex flow. An auxiliary solids outlet, referenced 132 is formed in side-wall 110 with an outlet nozzle, referenced 130 disposed at angle $\beta$ to the tangential direction of flow of the vortex, at the point of exit and having an outlet control valve, referenced 134. Fixably attached to valve 134 is a return feed valve, referenced 138 (FIG. 1) for returning generally large-sized solid particles through conduit 136 into axial feed inlet 116 and thereby into working chamber 104. This provides control, specifically with regard to the rate of comminution and to the range of particle sizes.

Operation of mill 100 includes introducing working fluid generally tangentially into the working chamber 104 through inlet nozzle referenced 212 (FIG. 1) so as to give rise to a vortex fluid flow, in accordance with the preferred embodiment of the present invention and variations thereof. Feed material to be comminuted is introduced into working chamber 104 through feed inlet 116 into the vortex flow. As solid material accumulates and is milled within the working chamber 104, comminuted solids and working fluid is discharged through discharge port 124 into discharge collector 126 and exits therefrom through outlet 128.

The inventor has ascertained that a high degree of comminution and a narrow range of particle size may be achievable by removing from working chamber 104, through valve 134, partially comminuted and oversize material, which is generally found close to side-wall 110. Such partially comminuted and oversize material may be recycled through return valve 138 and conduit 136 into working chamber 104 through inlet 116 for further comminution, in accordance with the preferred embodiment of the present invention and variations thereof.

Furthermore, it will be appreciated be persons skilled in the art, that the flow rate of working fluid introduced into working chamber 104 through inlet nozzle 214 is a factor in determining the frequency of controlled perturbation within the vortex. Also, the relative flow rate of working fluid introduced through inlet nozzle 214 and that introduced through auxiliary nozzle 240 into chamber 104, contribute to the controlled perturbations within working chamber 104 and to deflection of solid particles across the vortex flow, thereby to provide a further means for controlling the degree of comminution. In addition, the greater the angle $\alpha$ (to an effective maximum of about 90°), the greater is the controlled perturbation effected and, consequently, the greater is deflection of solid particles across the vortex flow and thereby, the greater is the degree of pulverization. Controlling the flow of partially milled solids through valve 134 and the flow of recycled partially milled solid material through return valve 138, influences the degree of pulverization of the feed material. The ratio of solid material entering the working chamber 104 through axial inlet 116 and auxiliary inlet 118 also influences the degree of pulverization. Controlling emission of comminuted solids from working chamber 104 by varying the cross sectional area, that is, the outer diameter of discharge port 124, additionally provides means for controlling the degree of pulverization.

The position of distal end referenced 115 (FIG. 2) of feed inlet 116 relative to discharge port 124 also has been found to provide a means for controlling the comminution of solid feed material as well as a means for facilitating a pre-sorting of the feed material. Solid feed material frequently includes a proportion of undersized particles as well as a proportion of particles within a desired particle size range. It is undesirable to further mill these particles because this generally results in production of additional undersized particles as well as needlessly utilizing additional energy. Raising feed inlet 116 so that distal end 115 of feed inlet 116 is positioned close to or even outside of working chamber discharge port 124, facilitates suction of feed material into the vortex in the vicinity of discharge port 124. Thus, raising feed inlet 116 has been found to result in a significant proportion of finer particles being carried directly into collection chamber 126, in the working fluid discharging from working chamber 104. Thus, interaction between discharge flow through discharge port 124 and feed material emitted from distal end 115 of feed inlet 116 provides a pre-sorting of the feed material, thereby reducing production of excessive amounts of undersized particles and energy wastage otherwise caused by further comminution of these fine particles.

In accordance with an alternate embodiment of the present invention, there is included within working chamber 104 a wear-resistant mechanical element referenced 302, moving generally about working chamber 104 under the influence of the vortex flow therein, thereby to induce perturbations to the vortex flow.

An additional feature, in accordance with the preferred embodiment of the present invention and variations thereof, for regulating the comminution of feed solids relates to a high velocity feed through a nozzle, impacting against a baffle surface, prior to entering working chamber 104. This feature, apart from providing a limited degree of impact comminution, improves dispersion of the feed solids into a vortex mill without the high velocity entry distorting or destroying the vortex flow. A feed system utilizing an ejector, for example, provides the necessary particle velocity for such an initial impact milling procedure.

Figure 4:
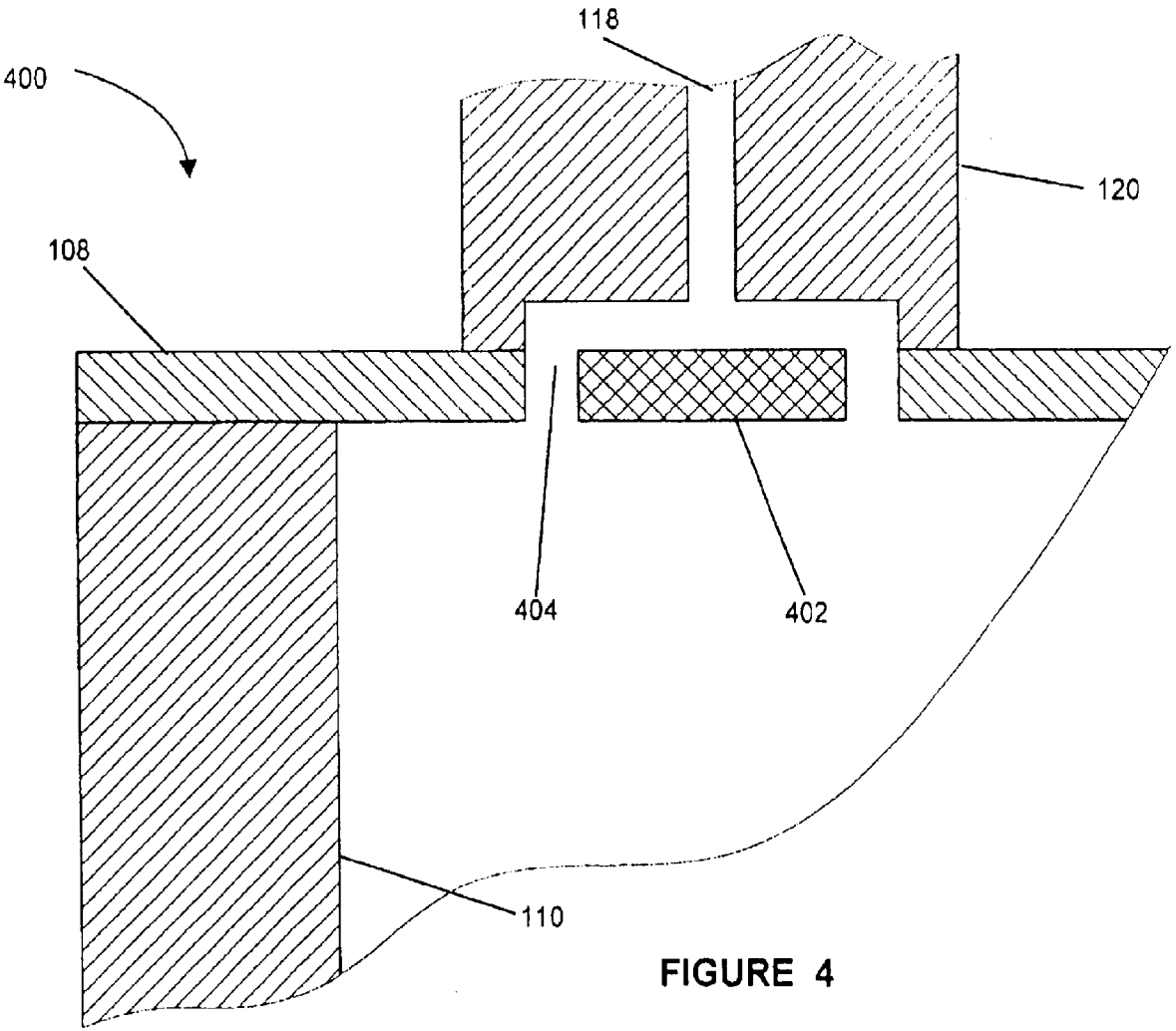
FIG. 4 illustrates an enlarged cross sectional view of a solids feed inlet having a diffuser baffle formed therewith, similar to that seen at B in FIG. 1 but constructed in accordance with an alternative embodiment of the present invention.

Referring now to FIG. 4, this illustrates an enlarged cross sectional view of FIG. 1 section C, wherein additional solids feed inlet 120 and nozzle 118 is fixably formed in upper end wall 108 disposed therein in relation to side-wall 110 of working chamber 104. A baffle, referenced 402 is fixably mounted in recess, referenced 404 in upper end wall 108, thereby to reduce the entry velocity of solids into chamber 104 and to deflect and diffuse entry of the solid material.

Figure 5:
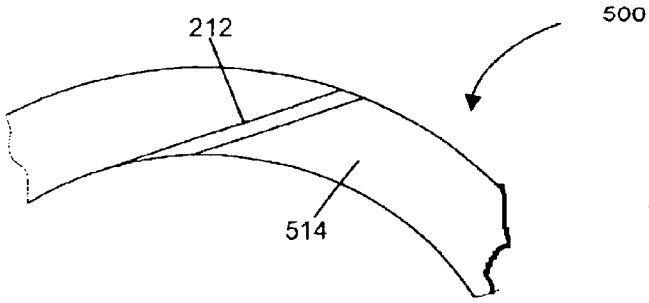
FIG. 5 illustrates a partial cross sectional view of a generally tangential working fluid inlet formed in an inward facing surface of a cylindrical side-wall of a working chamber.
Figure 6:
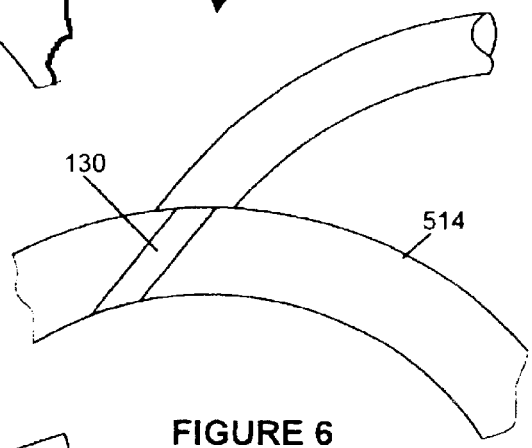
FIG. 6 illustrates a partial cross sectional view of an auxiliary outlet formed in an inward facing surface of a cylindrical side-wall of a working chamber.
Figure 7:
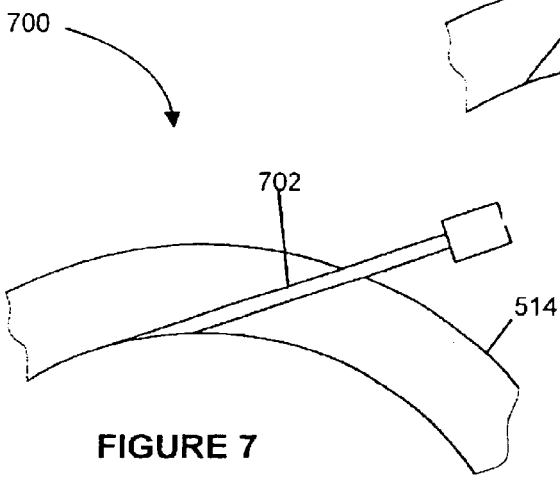
FIG. 7 illustrates a partial cross sectional view of an auxiliary feed inlet formed in an inward facing surface of a cylindrical side-wall of a working chamber.
Figure 8:
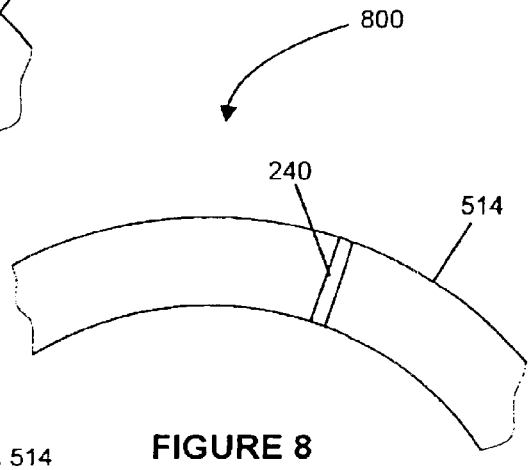
FIG. 8 illustrates a partial cross sectional view of an auxiliary working fluid inlet formed in an inward facing surface of a cylindrical side-wall of a working chamber.

In accordance with an additional embodiment of the present invention, a working chamber side-wall is formed of one or more functional inserts having a generally cylindrical closed shape and coaxially disposed. Referring now to FIG. 5, there is seen formed within a functional insert side-wall referenced 514 of a working chamber generally referenced 500, a tangential working fluid inlet referenced 212. Working fluid is introduced into working chamber 500 via working fluid inlet 212, thereby to cause a vortex flow therein. Furthermore, referring to FIG. 6, there is seen formed within functional insert side-wall 514 or within an end wall (not shown) of a working chamber generally referenced 600 an auxiliary discharge port referenced 130 thereby to discharge oversized and partially milled solid particles. Referring now to FIG. 7, there is formed within side-wall 514 or within an end wall (not shown) of a working chamber generally referenced 700, an auxiliary feed inlet referenced 702. Also, referring to FIG. 8, there is formed within side-wall 514 or an end wall (not shown) of a working chamber generally referenced 800, an auxiliary working fluid inlet referenced 240, thereby to induce perturbations to the vortex flow.

Figure 9:
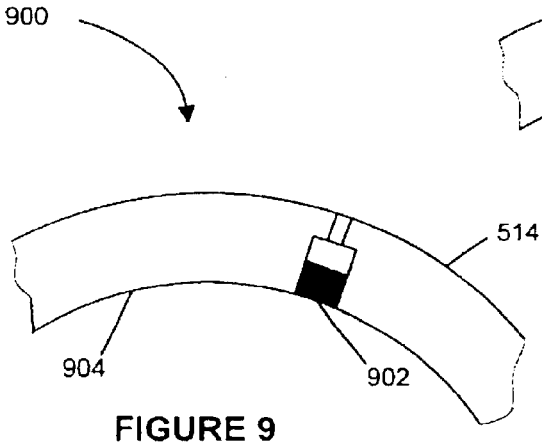
FIG. 9 illustrates a partial cross sectional view of a mechanical elastic oscillation generator disposed in an inward facing surface of a cylindrical side-wall of a working chamber.

In accordance with an additional embodiment of the present invention, referring now to FIG. 9, there is seen a partial cross-sectional view of a functional insert side-wall, generally referenced 900. A mechanical elastic oscillation generator referenced 902 is disposed in an inward facing surface referenced 904 of a cylindrical side-wall 514. Operating oscillation generator 902 utilizing a preselected amplitude and frequency of oscillation, the rate and degree of comminution is controlled as a result of applying perturbations to the vortex flow and to the solids within working chamber 900. Alternatively, mechanical elastic oscillation generator 902 is disposed in an end wall (not shown).

Figure 10A:
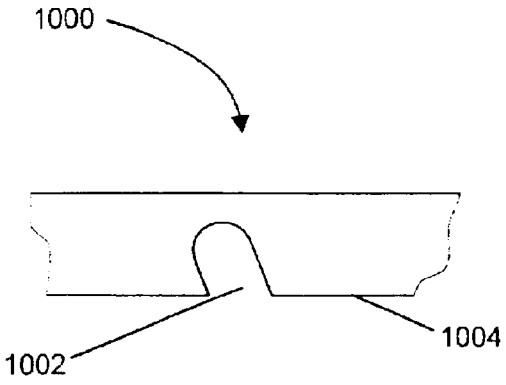
FIG. 10 illustrates a partial cross sectional view of a resonating recess formed in an inward facing surface of a cylindrical side-wall and in an end wall of a working chamber.

Referring now to FIG. 10A, there is seen, in accordance with an embodiment of the present invention, a partial cross-sectional view of an end wall referenced 1000 having a recess referenced 1002 formed in an end surface referenced 1004 thereof. Recess 1002 provides a resonating effect in the vortex flow, thereby causing controlled perturbations in the vortex flow.

Figure 10B:
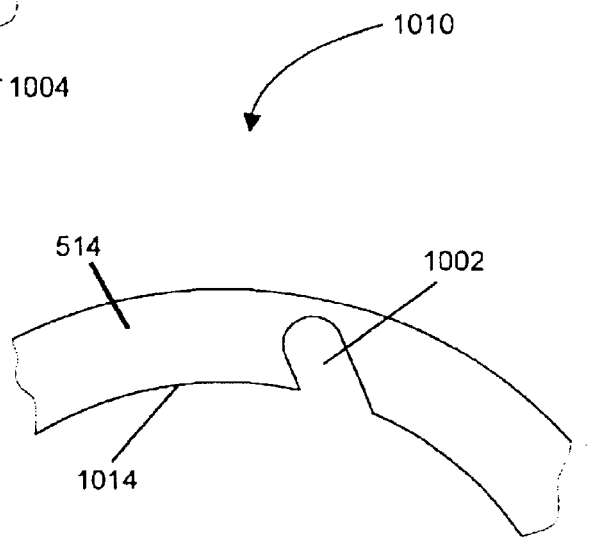

Referring now to FIG. 10B, there is seen, in accordance with another embodiment of the present invention, a partial cross-sectional view of a functional insert generally referenced 1010. Functional insert 1010 has a recess referenced 1012 formed generally non-tangential to the vortex flow in an inward facing surface referenced 1014 of a functional insert side-wall 514. Recess 1012 provides a resonating effect in the vortex flow, thereby causing controlled perturbations in the vortex flow.

Figure 11:
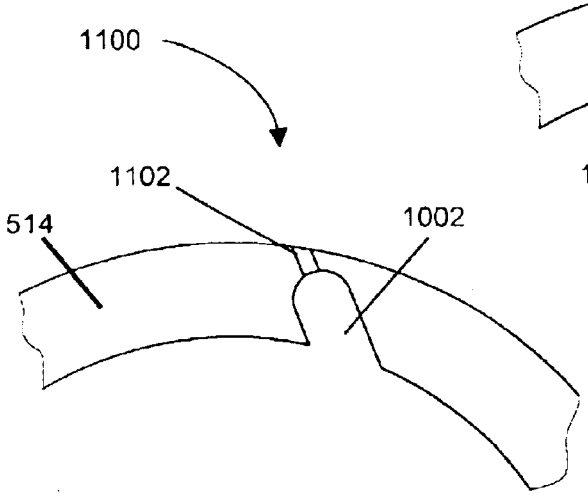
FIG. 11 illustrates a partial cross sectional view of a resonating recess, formed in an inward facing surface of a cylindrical side-wall of a working chamber, having an inlet or outlet in fluid flow communication with the recess.
Figure 12:
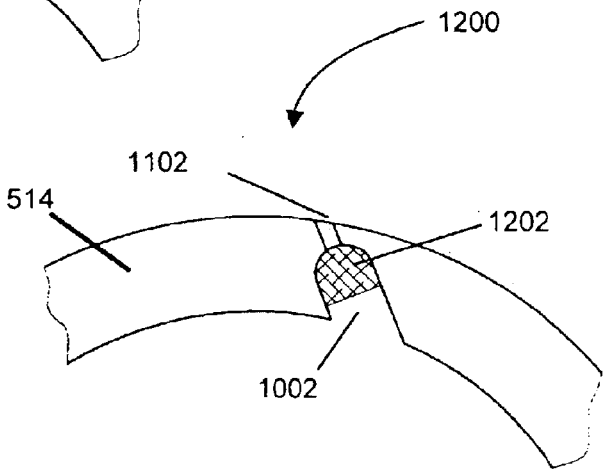
FIG. 12 illustrates a partial cross sectional view of a resonating recess, formed in an inward facing surface of a cylindrical side-wall of a working chamber, having an inlet or outlet in fluid flow communication with the recess, and having a diffusing medium formed in the recess.

Referring now to FIG. 11 and in accordance with a variation of an added embodiment of the present invention, there is seen a partial cross-sectional view of a working chamber, generally referenced 1100. An auxiliary inlet or, alternatively, a discharge port, referenced 1102 is formed in side-wall 514 or, alternatively, in an end wall (not shown), in fluid flow communication with recess 1002. Working fluid entering through auxiliary inlet 1102 provides additional controlled perturbations to the vortex flow, thereby to improve comminution of the solids within the working chamber. Alternatively, utilized as an auxiliary discharge port 1102, this enables the discharge of oversized or partially milled solid material moving about inward facing surface 1112 of side-wall 514. Further, referring to FIG. 12, there is seen in working chamber, generally referenced 1200, formed in inward facing surface referenced 1204 of side-wall 514 or, alternatively, in an end wall (not shown), a working fluid inlet in fluid flow communication with recess 1002, recess 1002 having a diffusion medium referenced 1202 formed therein.

Figure 13:
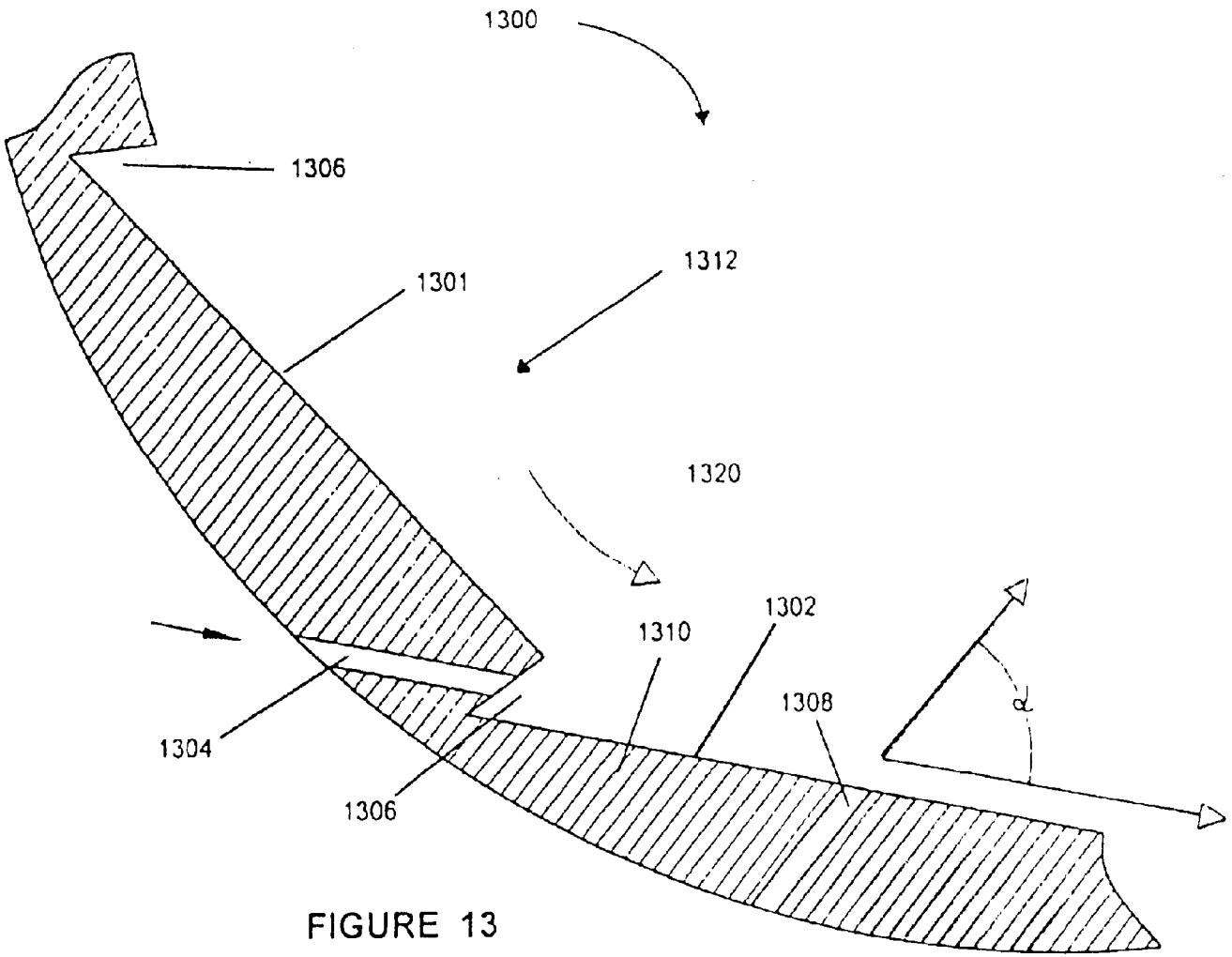
FIG. 13 illustrates an enlarged radial cross section partial view of a of a working chamber, seen to have a plurality of planar side-walls, in accordance with an alternative embodiment of the present invention.

In accordance with a preferred embodiment of the present invention and variations thereof, additional mechanical apparatus combined with controlled flow rate of working fluid further facilitates comminution by introducing controlled perturbations into the vortex flow and by deflection of particle flow away from or, in some cases, towards the side-wall. Referring now to FIG. 13, there is illustrated a radial cross section view of a section generally referenced 1300 of a working chamber referenced 1312 of a generally cylindrical side-wall referenced 1310 having a closed geometric shape working chamber. Substantially planar inner side-wall sections, referenced 1301 and 1302 are formed in the inner surface of side-wall 1310. Working fluid inlet, referenced 1304 is formed within recess, referenced 1306 located between adjacent substantially planar side-wall inner surfaces 1301 and 1302. Inlet 1304 is directed generally parallel to substantially planar side-wall 1302 and generally tangentially into working chamber 1312 to provide a vortex flow as indicated by arrow 1320 therein. One or more auxiliary working fluid inlets referenced 1308, direct working fluid flow at an angle $\alpha$ to surfaces 1302 and, thereby, at angle α to the tangential direction of vortex flow therein at the points of entry of auxiliary inlets 1308. This deflects the vortex flow 1320 and causes controlled perturbations thereto. As will be recognized by persons skilled in the art, controlling the flow rate of working fluid introduced through auxiliary inlets 1308 influences both amplitude and frequency of the induced controlled perturbations and thereby the degree of comminution.

There is a substantial radial pressure gradient across the vortex flow from inner surface 1302 to the vortex axis. Working fluid entering chamber 1312 via one or more auxiliary inlets 1308 causes a series of deflections of the vortex flow 1320 and wave-like controlled perturbations in the vortex. Thereby, the flow of solid particles, close to wall surface 1302, is deflected across the vortex flow 1320 and thereby subjects the particles to pressure perturbations. The solid particles flowing close to wall 1302 are generally large sized particles requiring comminution. Deflection across vortex flow 1320 causes, in accordance with the inventor's findings, a rapid change or oscillation in pressure exerted within and outside of each particle. This results in a resonance effect and consequent spontaneous particle disintegration. Increasing angle α from zero to 90° generally increases the induced perturbations.

In order to control and achieve a moderate degree of comminution together with a high solid material throughput, it is only necessary to retain solids within the chamber for a relatively short period of time. Furthermore, it is desirable that the fraction of feed material already at or below the required particle size range should not be further reduced to under-sized particles and are caused to exit the working chamber as quickly as possible.

Figure 14:
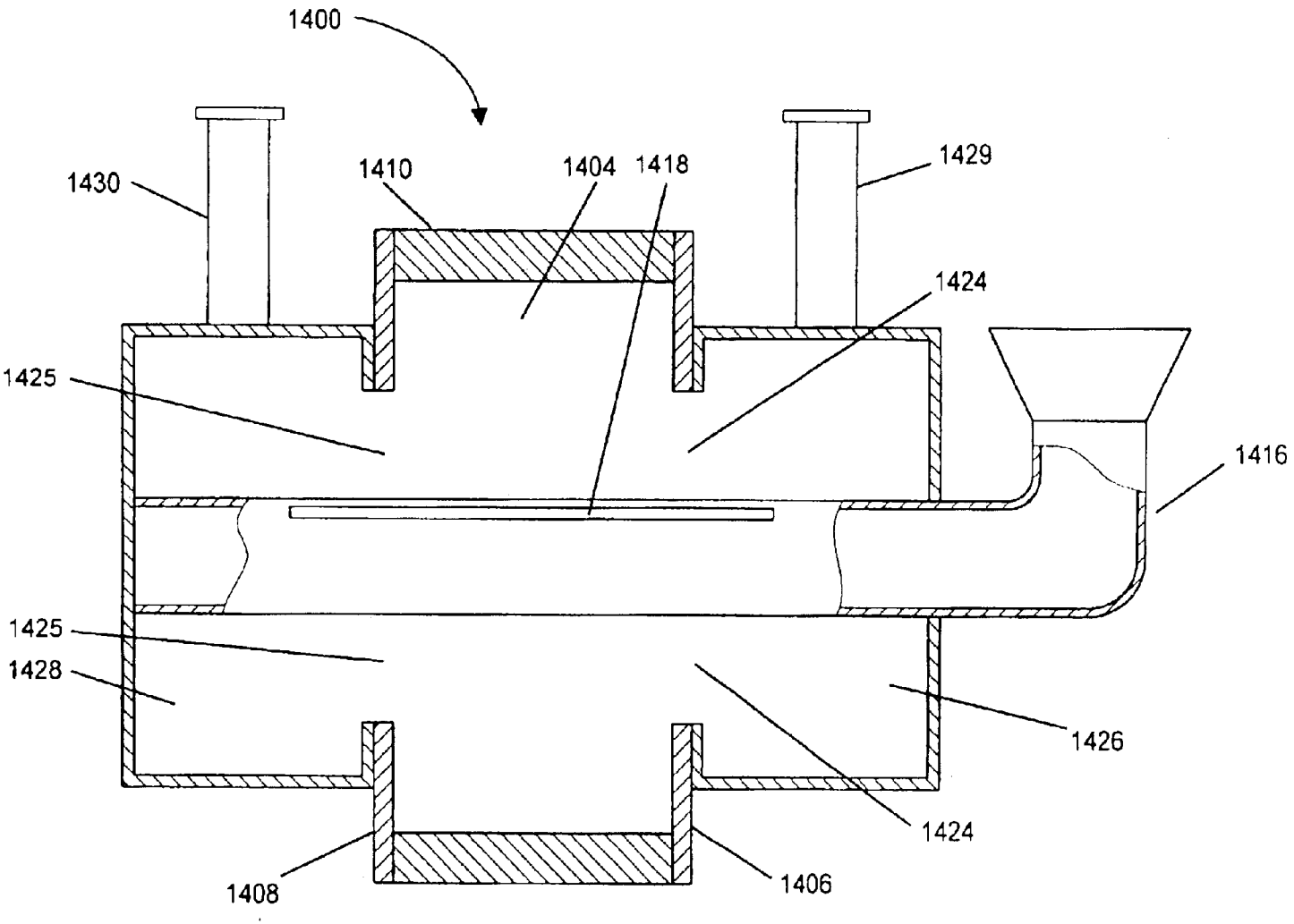
FIG. 14 illustrates a schematic axial cross sectional view of a vortex mill with two discharge ports, in accordance with an alternative embodiment of the present invention.

Referring now to FIG. 14, there is seen a schematic axial cross sectional view of a vortex mill generally referenced 1400. Mill 1400 has two discharge ports referenced 1424 and 1425, a working chamber referenced 1404 having a cylindrical side-wall referenced 1410 and a pair of end walls referenced 1406 and 1408, transversely fixably attached thereto. Fixably attached to each end wall 1406 and 1408 and coaxial thereto are two collection chambers referenced 1426 and 1428 respectively, each with a discharge collector outlet 1429 and 1430 respectively. Solid material is fed through solids feed inlet referenced 1416 and enters into working chamber 1404 through a feed slot referenced 1418. Comminuted solids leave working chamber 1404 through annular discharge ports referenced 1424 and 1425, respectively, in end walls 1406 and 1408 to enter discharge collectors 1426 and 1428, respectively, for discharge from collector outlets 1429 and 1430 respectively. The effect of having more than one discharge port is to reduce the axial velocity of particles escaping working chamber 1404.

Vortex mill 1400 includes two exit openings 1424 and 1425 and two discharge collectors 1426 and 1428, respectively, thereby to enable a substantially higher flow of both solid material and working fluid, for a predetermined degree of comminution. Generally, though not specifically, the degree of comminution will be moderate at a high throughput rate utilizing two outlets. Furthermore, to avoid further comminution of correct or undersized particles, use is made of a feed slot 1418 extending into collection chambers 1426 and 1428. The consequence of this arrangement is to provide a pre-comminution controlled sorting process to remove finer particles and thereby to avoid the further comminution of such particles into under-sized particles, as described above in relation to FIGS. 1, 2 and 3.

Figure 15:
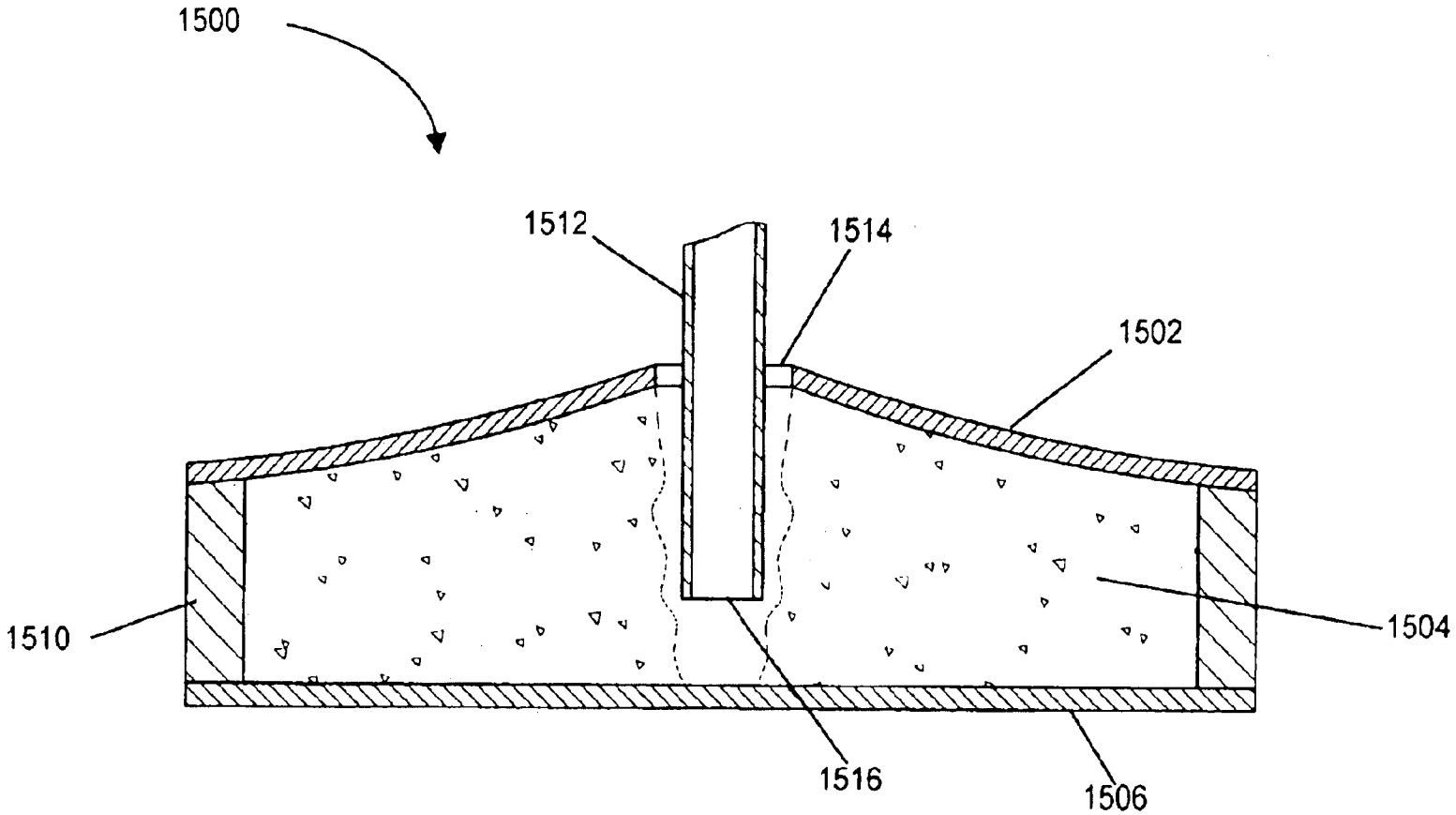
FIG. 15 illustrates a schematic axial cross sectional view of a vortex chamber, having a curved, generally conical shaped, upper end wall, in accordance with an alternative embodiment of the present invention.

An aspect of control of the comminution process is to retain larger particles within the working chamber until these are milled, while smaller particles, already within a desired size range, are caused to exit the chamber. Generally, within a working chamber, having planar end walls, the radial velocity component of milled particles moving towards the vortex axis, increases as the cross-sectional flow area decreases. In order to prevent this acceleration of the particles approaching the axis, it is necessary to increase the cross-sectional flow area. This is accomplished by utilizing curved, generally conical shaped, end walls Referring now to FIG. 15, this illustrates a schematic axial cross sectional view of a working chamber generally referenced 1500 having a curved, generally cone-like upper end wall referenced 1502, transversely attached to a side-wall referenced 1510. Cone-like end wall 1502 includes a coaxial feed inlet referenced 1512 and an annular discharge port referenced 1514. End-wall referenced 1506 transversely attached to side-wall 1510 is illustrated as having a flat shape in this figure although, having a similar cone-like shape to end wall 1502, further increases the effectiveness of the working chamber in specific circumstances by further slowing the radial particle movement towards the vortex axis. The shape of end wall 1502, therefore, represents a means for controlling the radial flow velocity component of solid particles, generally moving within the vortex in a radial direction towards discharge port 1514 and thereby achieves greater comminution.

Essentially, two forces influence the movement of each particle, rotating within the vortex flow indicated by arrow 1504. The centrifugal force resulting from the vortex rotation is in a radial outward direction. However, the pressure gradient within the vortex exerts a centripetal force on each particle, that is, from the periphery towards the axis. End wall 1502 is a curved, generally conical shape so computed to reduce or eliminate the fall in cross-sectional flow area as particles move towards the vortex axis. As the cross-sectional flow area in the cone-like chamber decreases more slowly from the perimeter towards the axis, the inward radial flow velocity component of the particles is reduced, or, at least, caused to increase at a lesser rate. The balance between the radially inward and outward forces generally results in larger particles being driven outwards and away from the axis towards the perimeter, while smaller particles move towards the axis. The cone-like end wall shape facilitates this effect. By reducing the centripetal movement, larger particles are retained within the working chamber for longer periods than smaller particles, thereby resulting in further comminution of larger particles.

Furthermore, to facilitate removal of particles from the feed material, that are already smaller than or within the required particle size range and to avoid production of additional undersized particles, feed inlet 1512 is raised close to or beyond discharge port 1514. This provides a preliminary sorting of the feed material, as described above in relation to FIGS. 1, 2 and 3.

Several embodiments of the present invention include constructional features and inserts mounted within the working chamber to provide a multiplicity of controls of the comminution process and in order to provide specific comminution characteristics for specific solid materials. These features include a) multiple working chambers, arranged in a preselected sequence, having a preselected flow sequence from one to another, b) one or more feed inlets arranged co-axially or eccentrically, thereby to direct the solid feed material into specific chambers, c) one or more concentric rib-shaped baffles formed on end surfaces of one or both end walls, for directing solid particle flow away from the discharge ports, thereby top return particles into the main flow of the vortex or to retain larger sized particles within the chamber, d) longitudinal substantially curved baffles fixably attached to the inner surface of the chamber side-wall for directing the solids flow away from the side-wall and across the vortex flow, and e) flow restriction elements disposed between functional inserts, thereby to control particle flow from one to another.

Figure 16:
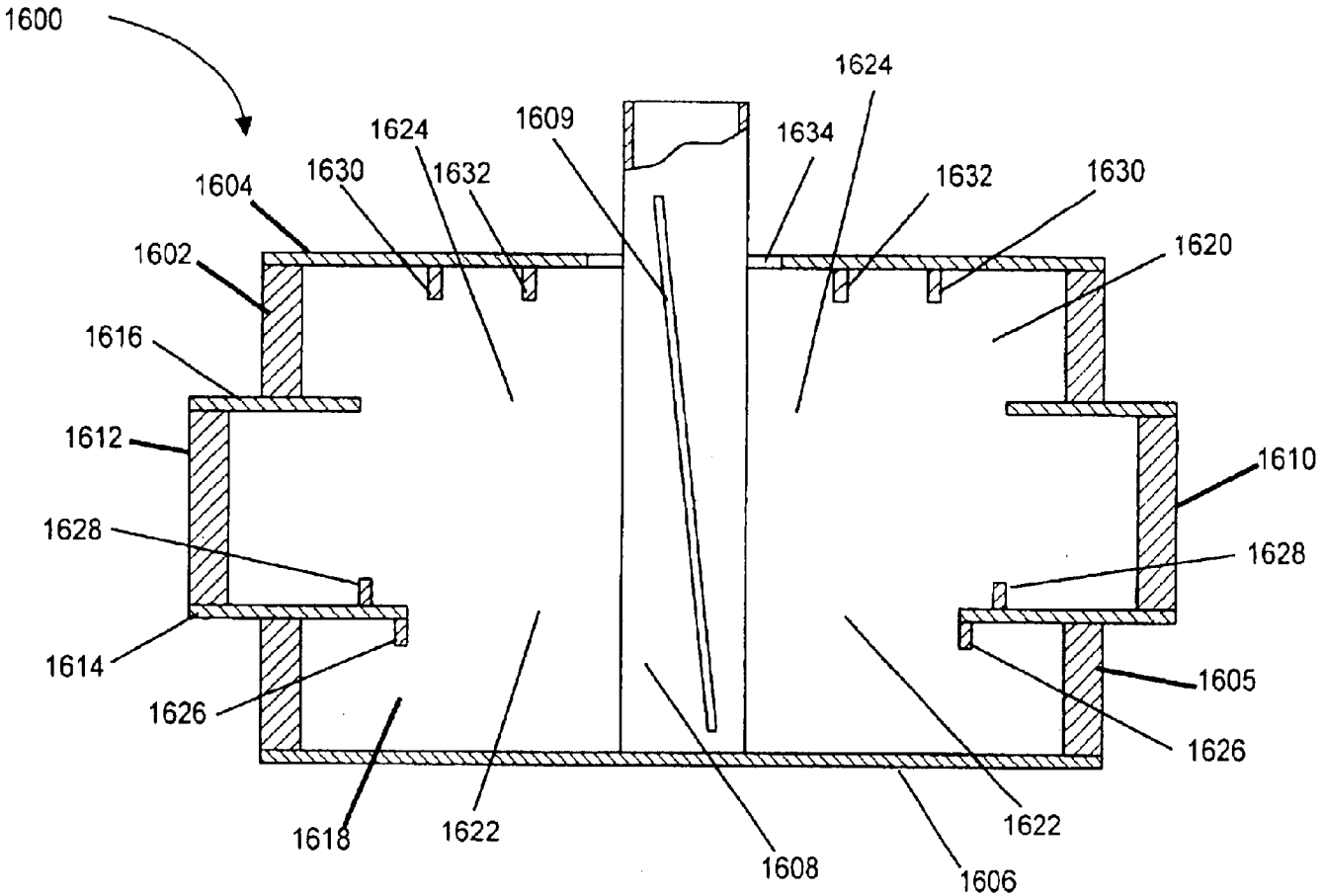
FIG. 16 illustrates a schematic axial cross sectional view of a vortex mill, having three coaxial functional inserts, in accordance with an alternative embodiment of the present invention.

Referring now to FIG. 16, there is seen a three-stage working chamber generally referenced 1600 having three coaxial functional inserts, namely a middle functional insert referenced 1610, a lower functional insert referenced 1618 and an upper functional insert referenced 1620 each having specific predetermined diameters and heights. Middle functional insert 1610 defines a cylindrical side-wall referenced 1612, a restriction element referenced 1614 and a restriction element referenced 1616 transversely fixably attached to a side-wall referenced 1612. Lower functional insert 1618 having a cylindrical side-wall referenced 1605 and lower end wall referenced 1606 transversely fixably attached thereto, is fixably attached coaxially to restriction element 1614 of middle functional insert 1610. Upper functional insert 1620 having a cylindrical side-wall referenced 1602 and upper end wall referenced 1604 transversely fixably attached thereto, is fixably attached coaxially to restriction element 1616 of middle functional insert 1610.

Restriction element 1614 of lower functional insert 1618 having a coaxial discharge port referenced 1622, enables discharge of solids from lower functional insert 1618 into middle functional insert 1610. Similarly, restriction element 1616 of middle functional insert 1610 having a coaxial discharge port referenced 1624, enables discharge of solids from middle functional insert 1610 into upper functional insert 1620. Further, upper end wall 1604, having a coaxial discharge port referenced 1634, enables discharge of final comminuted solids from upper functional insert 1620 into a discharge collector (not shown). Coaxial with chambers 1620, 1610 and 1618 there is seen a solids feed inlet referenced 1608, having a feed slot referenced 1609 disposed at an angle to the mill axis, for feeding solid material requiring pulverization, into chambers 1620, 1610 and 1618. Feed inlet 1608 is fixably attached to lower end wall 1606 and passes co-axially through discharge ports 1622, 1624 and 1634, thereby forming these as annular ports.

A multistage vortex mill arrangement such as that seen in FIG. 16 provides for a high degree of comminution of the feed material. To further enhance the degree of comminution, oversized particles are removed from the vicinity of the side or end walls for further comminution in the existing stage or in a subsequent milling stage.

In accordance with another embodiment of the present invention, to reduce the velocity of solid particles adjacent to restriction element 1614 in lower functional insert 1618 and thereby to prevent premature discharge of the solid particles from chamber 1618, there is included a cylindrical rib-shaped baffle referenced 1626 fixably attached to restriction element 1614, concentric with cylindrical side-wall 1605. Similarly, to reduce the velocity of solid particles adjacent to restriction element 1614 in middle functional insert 1610 and to prevent premature discharge of solid particles from chamber 1610, there is included a cylindrical rib-shaped baffle referenced 1628 fixably attached to restriction element 1614, concentric with cylindrical side-wall 1612. Further, in upper chamber 1620, fixably attached to end wall 1604, there are cylindrical rib-shaped baffles referenced 1630 and 1632 for redirecting the radial flow of solid particles back into the vortex and away from discharge port 1634.

Figure 17:
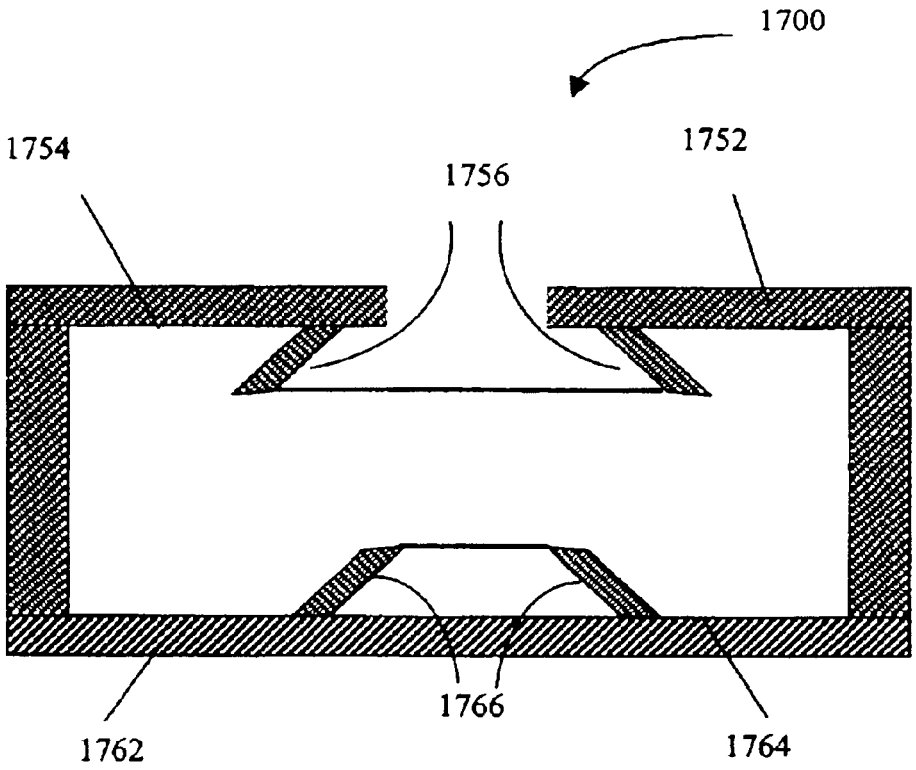
FIG. 17 illustrates a schematic axial cross sectional view of a working chamber having conical frustum rib-shaped baffles.

Referring now to FIG. 17, there is seen, by way of an example, a working chamber generally referenced 1700 including, fixably attached concentrically to an inward facing surface referenced 1754 of an upper end wall referenced 1752, a single inverted conical frustum shaped rib-shaped baffle referenced 1756, in accordance with a variation of an embodiment of the present invention. Furthermore, in accordance with another variation of an embodiment of the present invention, there is seen, fixably attached to the inward facing surface referenced 1764 of the lower end wall referenced 1762, a single conical frustum shaped rib-shaped baffle referenced 1766. Depending on the extent to which particles of solid material are to be retained within the vortex and close to the inner facing end walls, thereby to increase the degree of comminution and to produce a controlled particle size range, several such rib-shaped baffles are concentrically fixably attached to the inward facing surface of either end wall.

Figure 18:
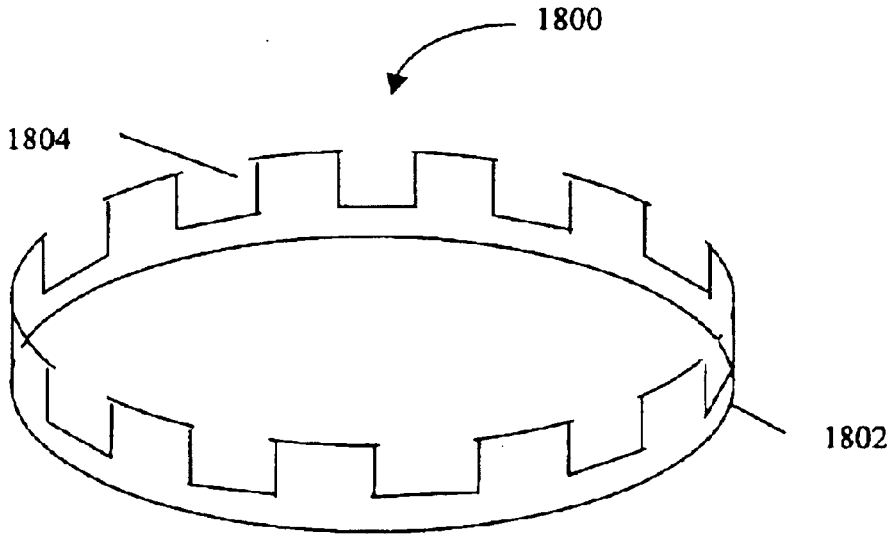
FIG. 18 illustrates a schematic view of a rib-shaped baffle having openings formed about the circumference thereof.

According to further variations of embodiments of the present invention, referring now to FIG. 18, there is seen a discontinuous rib-shaped baffle generally referenced 1800. A limited radial movement of particles is caused across the vortex flow through openings referenced 1804 formed at predetermined intervals in the circumference of the rib-shaped baffle 1802.

For each vortex mill system, there is defined a maximum solids feed rate whereby to achieve a predetermined degree or rate of comminution. In the case of an open system, that is, having both feed inlet and discharge outlet open to the atmosphere, or in a system having a discharge collector with a pressure substantially similar to atmospheric pressure, vortex rotation causes a vacuum to be formed at the vortex axis. This facilitates drawing solids into the working chamber. However, with increasing the rate of addition of solids to the working chamber, the vortex flow rate is reduced and the vacuum at the center falls to zero when the maximum feed rate is reached. Thereupon feeding under pressure is necessitated. Examples of mechanical devices for feeding include a screw feeder, conveyor, auger feeder and rotary feeder, each of which may require an airlock system to prevent pressure in the working chamber from blowing in the reverse direction to the feeder. A non-mechanical feeder that facilitates feeding into a working chamber under pressure is an ejector. An ejector utilizes pressurized working fluid passing through a venturi for causing solids to be drawn into the working fluid stream, thereby to introduce solids and working fluid into the working chamber under pressure.

Figure 19:
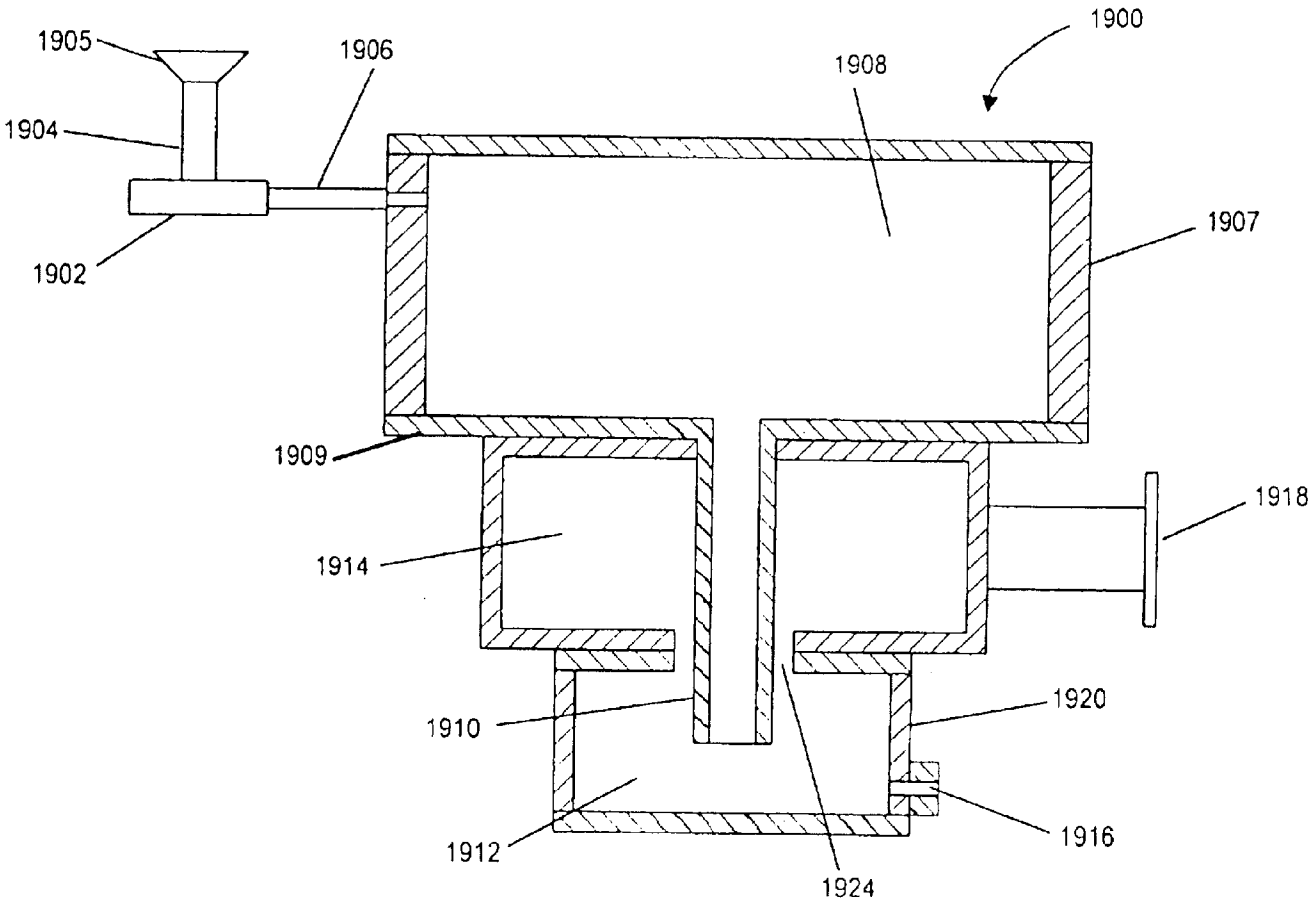
FIG. 19 illustrates a schematic cross sectional view of a vortex mill having an ejector drawing solid feed material into a first working chamber and, thereafter, into a second working chamber, in accordance with alternative embodiments of the present invention.

Referring now to FIG. 19, there is illustrated a schematic cross sectional view of a vortex mill generally referenced 1900, having an ejector referenced 1902, operated with working fluid, drawing solid feed material from a feed vessel referenced 1905 into ejector inlet referenced 1904. The feed material is thereafter introduced substantially tangentially via ejector feed nozzle referenced 1906 formed in a side-wall referenced 1907 into a first working chamber referenced 1908. Chamber 1908 is fixably attached coaxially to discharge collector referenced 1914, which is fixably attached coaxially to a second working chamber referenced 1912. Solids and working fluid are fed from first working chamber 1908 into second working chamber 1912 via a feed inlet referenced 1910, fixably attached to a lower end wall referenced 1909. A vortex is sustained in chamber 1912 by introducing a flow of working fluid tangentially into chamber 1912 via one or more tangential inlet nozzles (not shown) formed in side-wall referenced 1920 of second working chamber 1912. Finely comminuted material and working fluid are discharged through discharge port referenced 1924 and discharge collector 1914 and are emitted from the milling system through discharge port referenced 1918. An auxiliary discharge port referenced 1916 facilitates the discharge of a substantial portion of oversize material for further comminution.

The degree of comminution of feed particles is controllable by adjusting the residence time in a working chamber. This is achieved by regulating the solid feed rate or by changing the flow area of the working chamber discharge port, generally by changing the inner or outer diameters of the discharge annulus.

Figure 20:
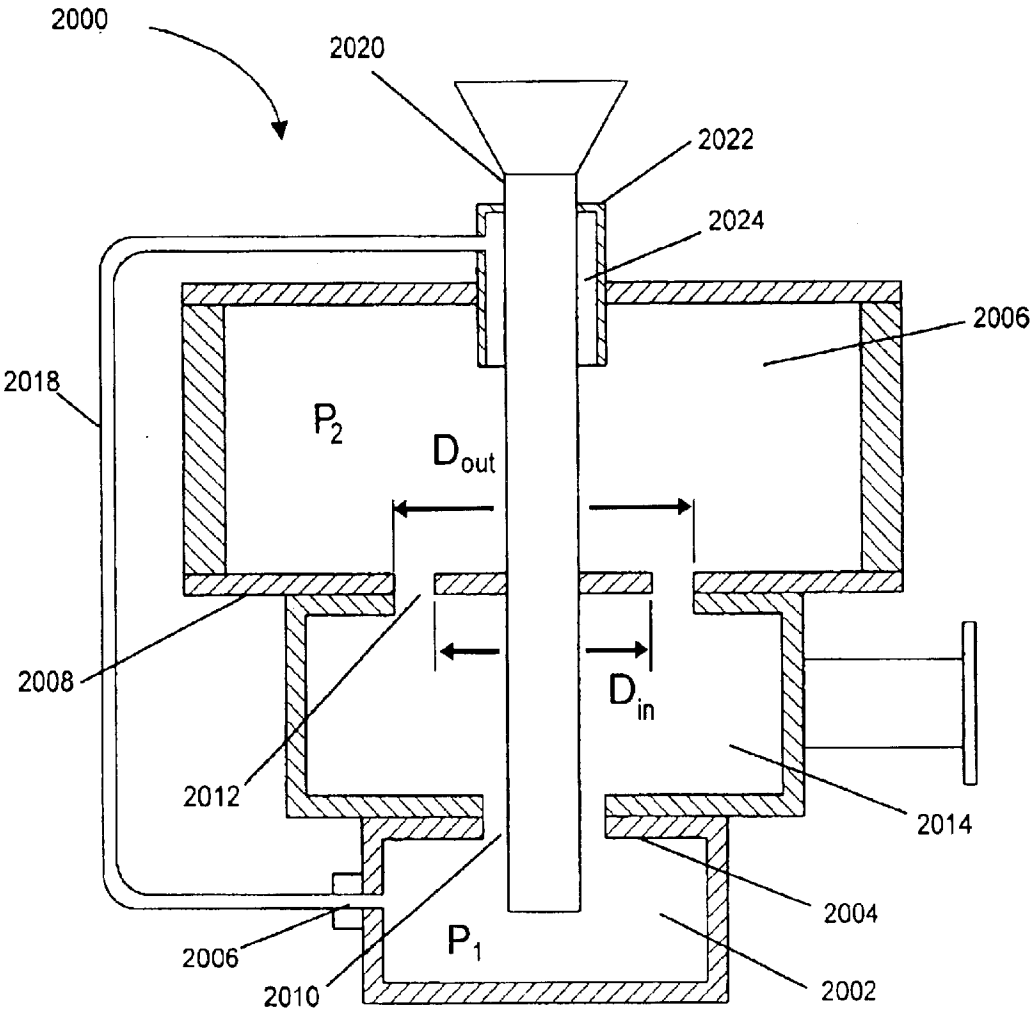
FIG. 20 illustrates a schematic view of a vortex mill, constructed in accordance with an alternative embodiment of the present invention, having a common discharge collector and two vortex chambers.

Referring now to FIG. 20, this illustrates a schematic view of a vortex mill generally referenced 2000 having, two coaxially disposed working chambers referenced 2002 and 2006 fixably attached to a common discharge collector referenced 2014. Formed in an upper end wall referenced 2004 of primary working chamber 2002, is a discharge port referenced 2010. Similarly, formed in lower end wall referenced 2008 of secondary working chamber 2006 is discharge port referenced 2012. Feed solids are introduced through an axial feed inlet referenced 2020 into primary working chamber 2002. Milled solids are discharged from primary working chamber 2002 through discharge port 2010 into discharge collector 2014.

Pressure $P_1$ at the periphery of chamber 2002 is generally greater than pressure $P_2$ at the axis of chamber 2006, which facilitates flow from chamber 2002 to chamber 2006. Large particles and partially milled particles are discharged from primary working chamber 2002 through auxiliary outlet nozzle referenced 2016 for introduction via conduit referenced 2018 and secondary feed inlet referenced 2022 into secondary working chamber 2006 for further comminution. Secondary feed inlet referenced 2022 is concentrically fixably attached to primary feed inlet 2020, providing a feed annulus 2024 for introducing large particles, discharged from auxiliary outlet nozzle 2016 of primary working chamber 2002, into secondary working chamber 2006 for further comminution. Comminuted material is discharged from secondary working chamber 2006 through discharge port 2012 into discharge collector 2014. To regulate the degree of comminution of particles emitted from secondary working chamber 2006 the cross sectional area of discharge port 2012 is variable, that is, inner annular diameter referenced Din and outer annular diameter referenced $D_{out}$ are variable.

The degree of comminution achieved using mill 2000 is controlled in a similar manner to that applicable to a single working chamber mill, such as that illustrated in FIGS. 1, 2 and 3. However, premature removal of oversized particles from primary chamber 2002 and introduction of these oversized particles into secondary working chamber 2006 substantially improves the control of comminution in each chamber. More particularly, the rate of comminution is accelerated, control of the range of particle size is better facilitated and energy consumption is reduced.

Figure 21:
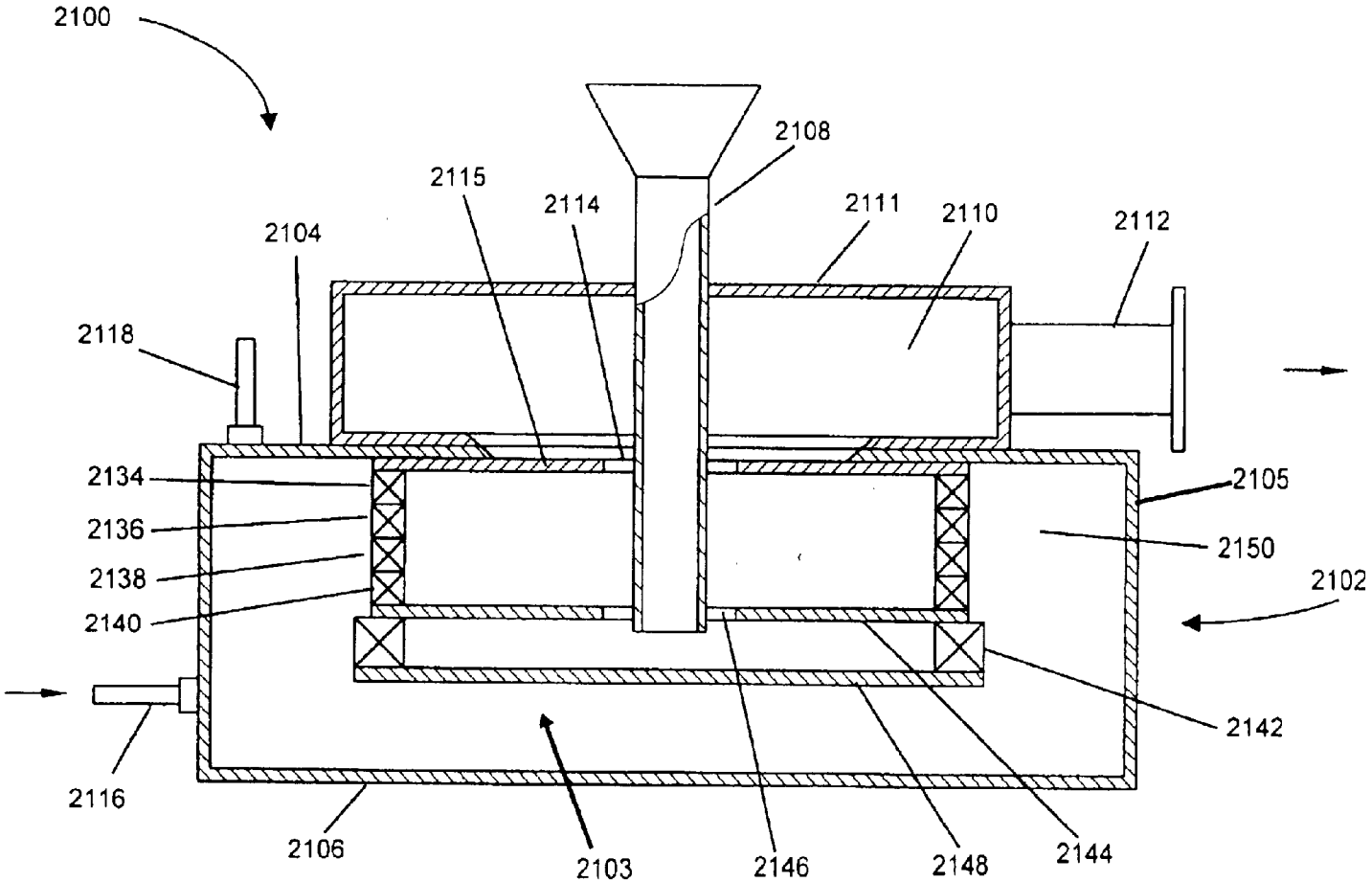
FIG. 21 illustrates a working chamber contained in an outer casing, having fixed therein multiple functional inserts constructed in accordance with a preferred embodiment of the present invention.

Referring now to FIG. 21, there is seen, according to a further preferred embodiment of the present invention, an improved vortex mill generally referenced 2100 having an outer casing generally referenced 2102. Casing 2102 is configured to surround and enclose a working chamber generally referenced 2103 and having spaced therefrom a contained volume referenced 2150 between casing 2102 and working chamber 2103.

Casing 2102 includes a generally cylindrical side-wall referenced 2105 and arranged transversely contiguously thereto is an upper end wall referenced 2104 and a lower end wall referenced 2106. A working fluid inlet referenced 2116 is disposed in side-wall 2105, thereby to introduce working fluid into contained volume 2150 and thereafter into working chamber 2103 via tangential inlets (not shown) to cause a vortex therein. An auxiliary discharge port referenced 2118 is disposed in upper end wall 2104. For introducing solid feed material into working chamber 2103, a feed inlet referenced 2108 is adjustably attached to an upper wall referenced 2111 of discharge collector 2110. There is formed in upper end wall 2104 a discharge port referenced 2114 through which working fluid and milled solid material are discharged from working chamber 2103 into a discharge collector referenced 2110 fixably attached externally to upper end wall 2104. Discharge collector 2110 has an outlet referenced 2112 formed thereto. Working fluid and comminuted solids are emitted from outlet 2112 for separation of the comminuted solid material from the working fluid using suitable separation equipment (not shown).

Working chamber 2103, constructed in accordance with a preferred embodiment of the present invention, is formed, for example, of functional inserts referenced 2134, 2136, 2138, 2140 and 2142.

Each functional insert 2134, 2136, 2138, 2140 and 2142 is generally formed having one or more of the features described hereinabove in relation to working chambers. Various combinations of a multiplicity of functional inserts, employed in a predetermined sequence, provide means for achieving comminution of a wide range of solid materials. Furthermore, each of the functional inserts 2134, 2136, 2138, 2140 and 2142, used in a preselected combination or sequence, may differ from one another in regard to geometric features such as diameter, height, inward facing surface configuration, end wall shapes and so on. Furthermore, functional inserts 2134, 2136, 2138, 2140 and 2142 may differ from each other with regard to working fluid inlets and the disposition thereof as well as apparatus formed therein to cause controlled perturbations of the vortex flow therein.

Additionally, according to another embodiment of the present invention, functional inserts 2140 and 2142 are seen to be separated by a flow restriction element referenced 2144, having formed coaxially therein an orifice referenced 2146, thereby to control discharge of solid particles from functional insert 2142. Also, transversely fixably attached to lower end of functional insert 2142 is an end wall referenced 2148, thereby to be a lower end wall to compound vortex mill 2103.

Figure 22:
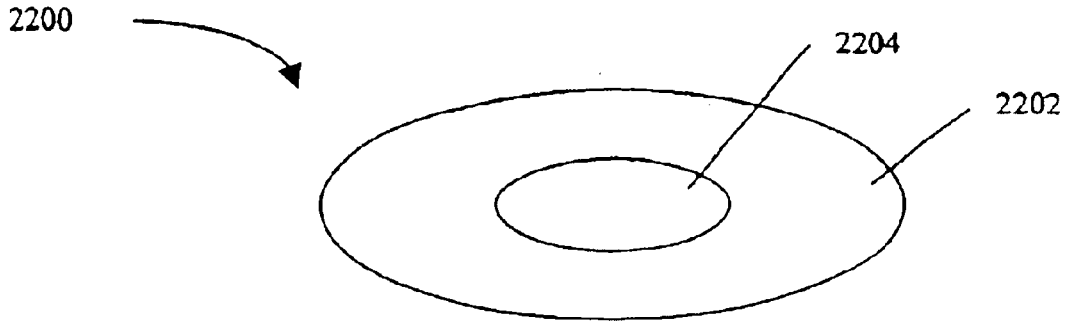
FIG. 22 illustrates a schematic view of a planar flow restriction element.
Figure 23:
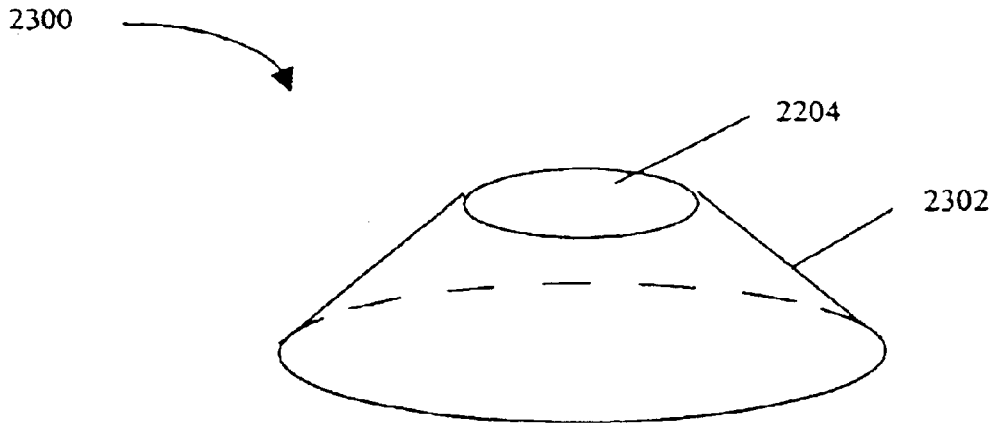
FIG. 23 illustrates a schematic view of a conical-frustum-shaped flow restriction element.
Figure 24:
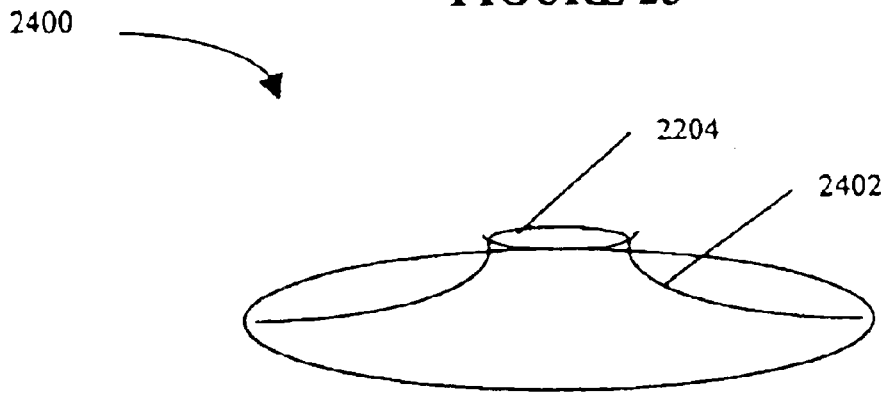
FIG. 24 illustrates a schematic view of a geometrically curved flow restriction element.

In accordance with variations of an embodiment of the present invention, referring now to FIG. 22, there is seen a circular flow restriction element generally referenced 2200, having a planar configuration referenced 2202 and having a coaxial orifice referenced 2204 formed therein. Also, referring to FIG. 23, there is seen a circular flow restriction element generally referenced 2300, having a conical configuration referenced 2302 and having a coaxial orifice referenced 2204 formed therein. Referring further to FIG. 24, there is seen a circular flow restriction element generally referenced 2400, having a geometrically curved configuration referenced 2402, and having a coaxial orifice referenced 2204 formed therein. Alternative configurations to those seen in FIGS. 22, 23 and 24 include flow restriction elements having one or more coaxial or non-coaxial orifices of varying diameters or shapes.

Flow restriction elements are utilized for disposition between adjacent working chambers, adjacent functional inserts, a functional insert and an upper end wall, or a working chamber and a discharge collector, thereby to control the discharge flow of solid particles leaving a chamber and thereby to modify the extent and rate of milling and to control the particle size range of milled solid material.

Figure 25:
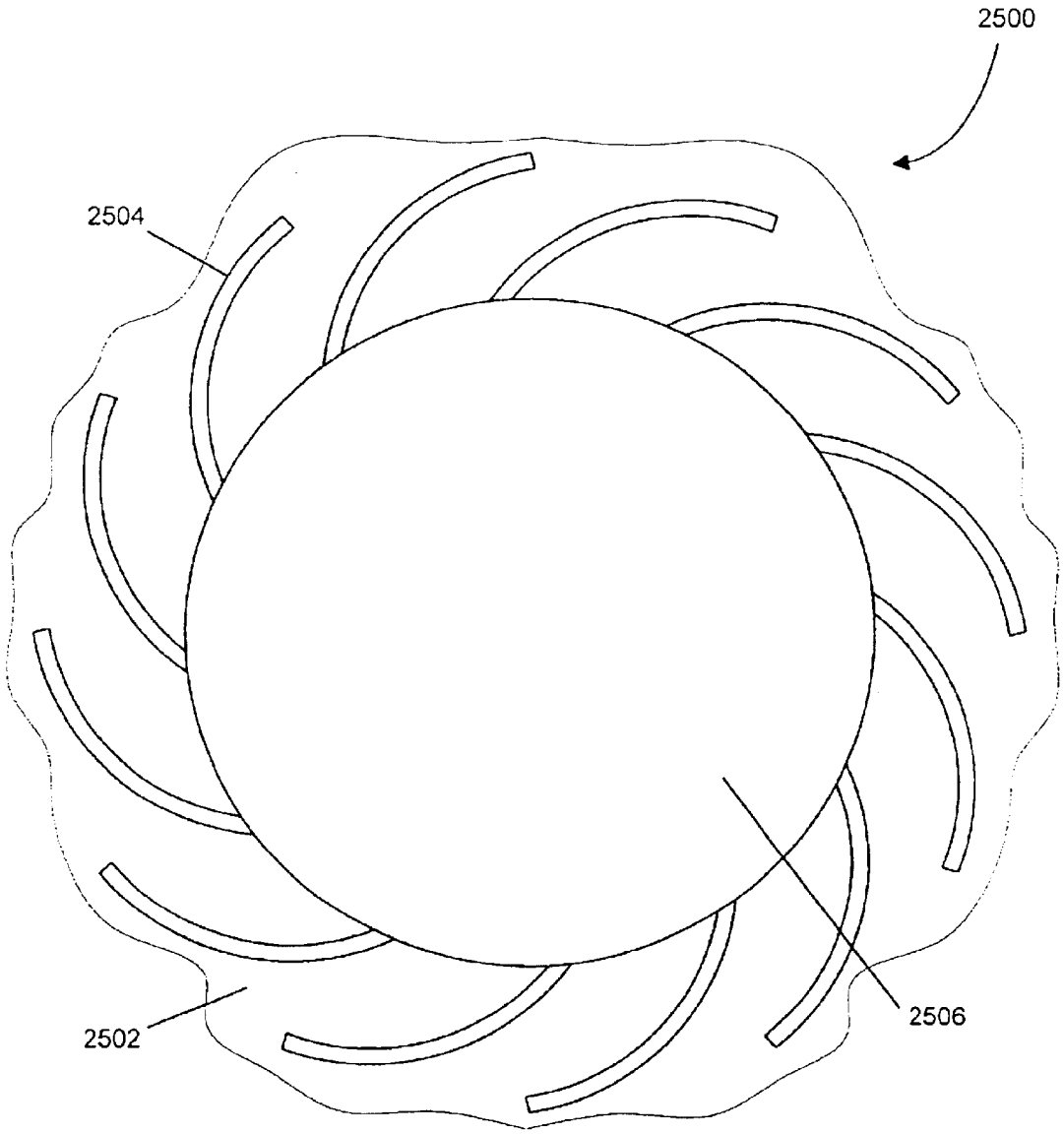
FIG. 25 illustrates a schematic partial plan view of a flow restriction element having vanes disposed thereon.

In accordance with a further variation of an embodiment of the present invention, referring to FIG. 25, there is seen a flow restriction element generally referenced 2500. Flow restriction element 2500 includes vanes referenced 2504 formed on a planar surface referenced 2502 and a discharge orifice 2506 formed therein. Vanes 2504 are formed thereby to deflect the vortex flow and the solid particles contained therein away from an inward facing surface of a side-wall of a vortex chamber across the vortex flow and towards discharge orifice 2506 generally towards the vortex axis. This flow causes the solid particles to be subjected to a significant and rapid pressure change, thereby inducing spontaneous comminution of the particles.

Figure 26:
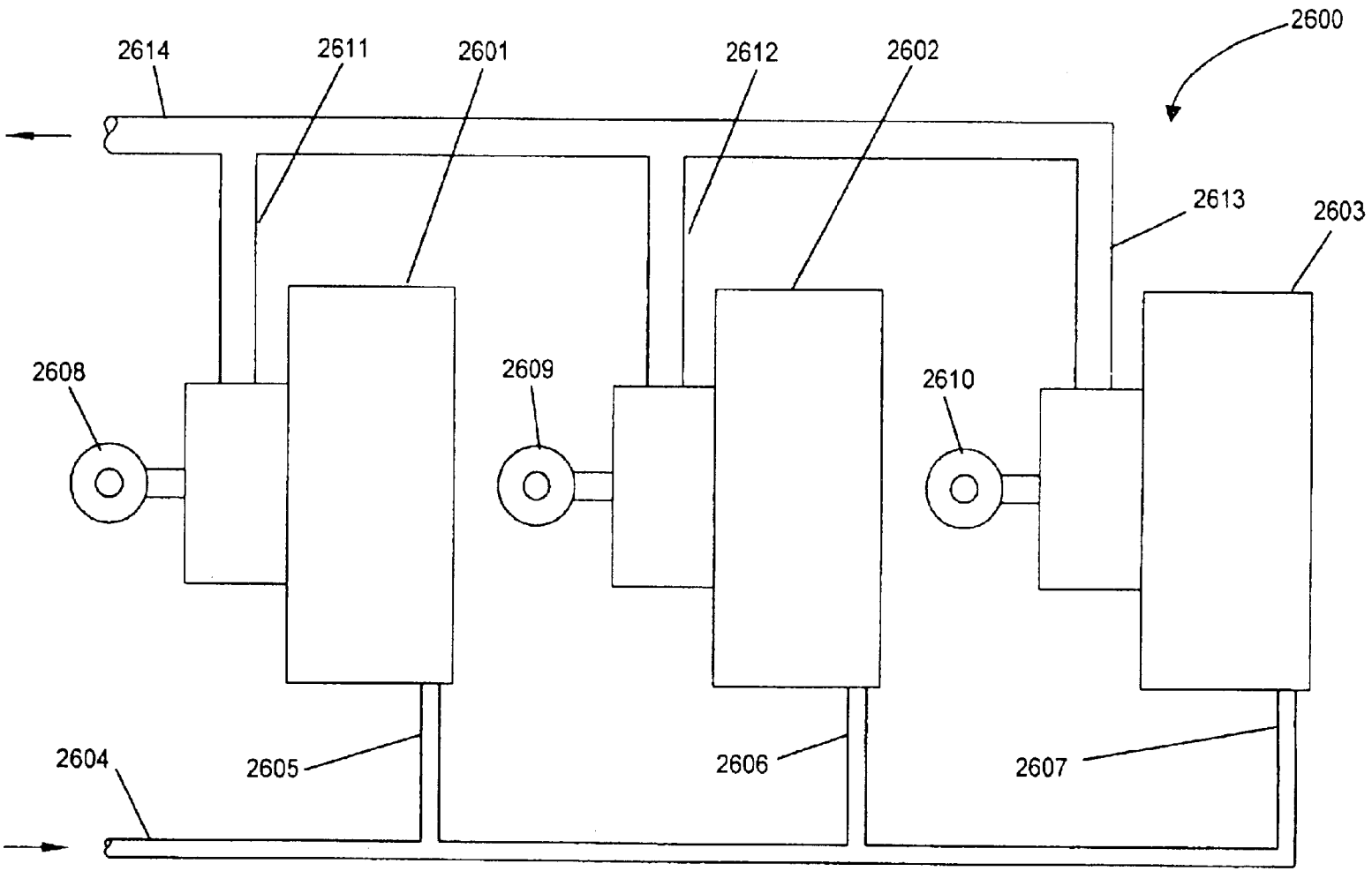
FIG. 26 illustrates a schematic arrangement of multiple vortex mills.

In order to achieve particular comminution results, the use of multiple vortex mills or multiple vortex chambers is expedient for increasing the throughput of solid material to be milled. Referring now to FIG. 26, there is seen a schematic view of an arrangement generally referenced 2600, three vortex mills referenced 2601, 2602 and 2603 are operated in parallel. Working fluid is supplied through a conduit manifold referenced 2604 into each of mill 2601, 2602 and 2603 via conduits 2605, 2606 and 2607 respectively, thereby to cause a vortex flow therein. Solid material to be milled is fed to mills 2601, 2602 and 2603 via feed inlets 2608, 2609 and 2610 respectively. Discharging working fluid and milled solids are discharged via discharge outlets 2611, 2612 and 2613 into a discharge manifold 2614. Thereafter, milled solids are separated from working fluid in suitable separation equipment (not shown).

Figure 27:
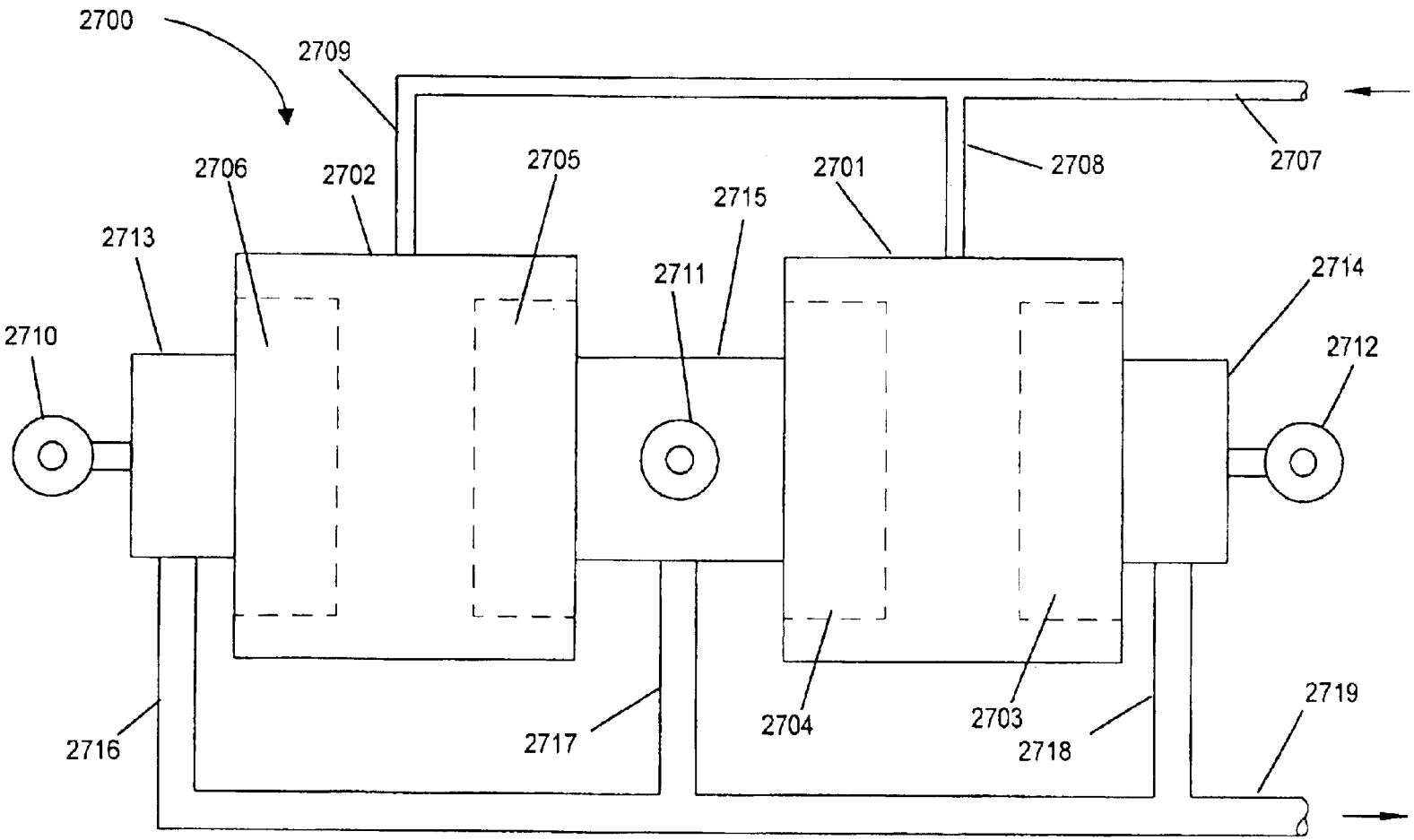
FIG. 27 illustrates a schematic arrangement of two pairs of vortex mills, each pair contained in a casing.

An alternative arrangement takes advantage of multiple vortex chambers formed within a casing and further the use of multiple such casings. Referring now to FIG. 27 there is seen an arrangement generally referenced 2700 including, as an example, two vortex mill casings referenced 2701 and 2702. Casing 2701 includes two vortex-working chambers referenced 2703 and 2704 which discharge into two discharge collectors referenced 2714 and 2715 respectively. Similarly, in casing 2702, there are working chambers referenced 2705 and 2706 discharging into discharge collectors referenced 2715 and 2713 respectively, that is, discharge collector 2715 is common to working chambers 2704 and 2705. Working fluid is supplied via a conduit manifold referenced 2707 and working fluid inlets referenced 2708 and 2709 into casings 2701 and 2702 respectively, thereby to cause vortices in each of working chambers 2703, 2704, 2705 and 2706. Solid feed material is fed into respective working chambers 2703, 2704, 2705 and 2706 from feed inlets 2710, 2711 and 2712, that is, feed inlet supplies material to both working chambers 2704 and 2705. Working fluid and milled solids are discharged via outlets 2716, 2717 and 2718 into a discharge manifold referenced 2719. Thereafter, milled solids are separated from working fluid in suitable separation equipment (not shown).

Figure 28:
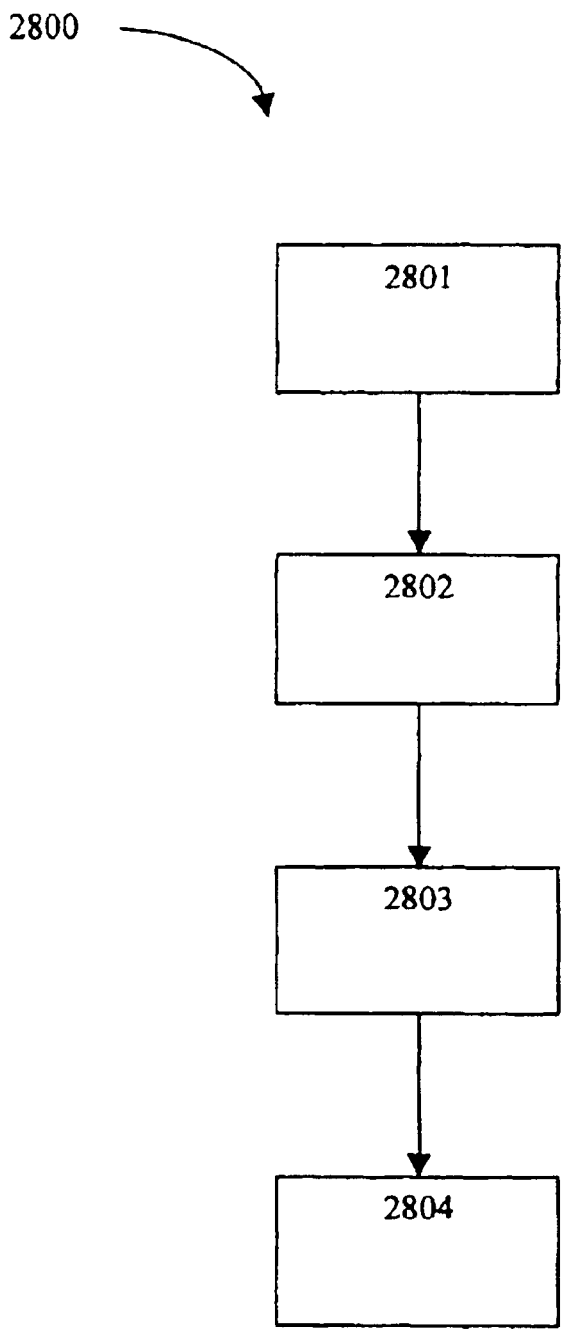
FIG. 28 illustrates a schematic view of a process for milling solid particulate material using an improved vortex mill.

The present invention further relates to a process for milling a substantially particulate solid material using an improved vortex mill. Referring now to FIG. 28, there is seen a schematic view of a process generally referenced 2800 for milling solid particulate material using an improved vortex mill. The process includes the steps of

2801, introducing a generally tangential flow of working fluid into a generally cylindrical working chamber thereby to create a vortex flow therein;

2802, feeding substantially particulate solid material sought to be milled into the working chamber such that the material is taken up in suspension in the vortex flow, thereby to apply comminution stresses to the suspended solid particles;

2803, inducing controlled perturbations in the vortex flow, thereby to regulate the comminution stresses applied to the suspended solid particles and thus also the rate of milling thereof; and

2804, discharging milled particulate solid material together with working fluid from the working chamber.

Comminution Control

An object of the present invention is to provide a controlled comminution of particulate solid material using a vortex mill. Controlling comminution includes regulating the degree and rate of comminution, energy usage, particle size and range of particle sizes. Control of comminution is achieved by adjusting parameters relating to amplitude and frequency of the oscillating or perturbation component of a working fluid, vortex flow velocity and improving vortex mill apparatus. Factors, which influence the amplitude and frequency of perturbations within the vortex, and which, also influence the vortex mill pulverization process include:

a) Parameters Relating To Working Fluid Flow:

i) the flow rate of tangentially introduced working fluid is controlled to vary the vortex flow and the perturbation frequency within the chamber, ii) additional working fluid enters the working chamber through one or more auxiliary inlets at an angle $\alpha$ (greater than zero) to the tangential vortex flow at the point of entry, where varying angle $\alpha$ creates a varying wave-like disturbance to the vortex flow at the point of entry, thereby causing solid particles to be deflected across the direction of the vortex flow, and iii) the flow rate of additional working fluid at angle $\alpha$ relative to the tangential air flow rate is controlled to vary both the amplitude and the frequency of perturbations within the vortex;

b) Parameters Related To Feeding Solid Material:

i) solid feed material is introduced into the chamber through one or more feed inlets or auxiliary feed inlets in the end walls or side-wall, ii) relative solids feed rates through one or more axial feed inlets and through one or more auxiliary feed inlets in the end walls or side-wall, iii) solid material feeding rate thereby influencing the degree and rate of pulverization, and iv) after a proportion of oversized or partially milled feed material is discharged from an auxiliary side-wall solid outlet of a working chamber (refer below to paragraph c)-ii) below), this partially milled solid material is re-introduced into the working chamber, or introduced into another working chamber;

c) Parameters Relating To Discharging Comminuted Material:

i) solid material, milled to a required degree, is discharged, together with working fluid, through one or more circular or annular axial discharge ports in one or more end walls of the mill chamber, the cross sectional area and diameter of each discharge port being pertinent to the degree of pulverization, and ii) large sized particles or partially milled solid material are discharged through one or more auxiliary side-wall or discharge ports, the axis of the ports being orientated to the tangential flow of the vortex at the point of outlet, such that the auxiliary discharge port opening faces generally away from the tangential direction of flow of the vortex; and d) Apparatus Influencing Vortex Flow Characteristics:

i) a plurality of substantially planar side-walls formed on the inner surface of a working chamber side-wall and, formed therein, one or more working fluid inlets, within a formed recess located between adjacent substantially planar side-walls, the inlet directed substantially parallel to the planar side-walls and generally tangentially into the working chamber, thereby to cause vortex flow and repeated perturbations in the vortex flow, ii) one or more auxiliary working fluid inlets are disposed at an angle $\alpha$ to the tangential direction of vortex flow, where varying angle $\alpha$ creates a wave-like perturbation disturbance to the vortex flow at the point of entry and, also, thereby causing solid particles to be deflected across the direction of the vortex flow, iii) one or more baffle inserts, flat or curved in the direction of the vortex flow, affixed to the inner surface of the side-wall of the chamber parallel to the axis, creates a varying wave-like perturbation disturbance to the vortex flow which deflects the flow of solid particles across the direction of the vortex flow, iv) end walls of a working chamber formed as flat, conic, frusto-conic or various coaxial geometrically generated shapes, each of which influences the degree and characteristics of the comminution process, v) concentric rib-shaped baffles of varying configurations, heights and sequence arrangement affixed to the inner surface of one or more end walls, form concentric annular channels on the inner surface of the end wall, thereby to influence the flow of solid particles adjacent to the end walls, vi) rotating plates mounted within the working chamber or close to the inner surface of one or more end walls of the working chamber or functional insert, thereby to influence the flow of particles, vii) inserted flow restriction elements disposed between adjacent working chambers or functional inserts or against either end wall of a working chamber, thereby to control, or restrict flow of solid particles therefrom, viii) one or more recesses formed in the inward facing surface of the working chamber side-wall or end walls, thereby to provide a resonating effect on the vortex flow, and ix) mechanical elastic oscillation generators disposed in an inward facing surface of a cylindrical side-wall or end walls of a working chamber thereby to cause perturbations within the vortex flow, and x) wear-resistant mechanical elements freely disposed within a vortex chamber, thereby to induce perturbations in the vortex flow.

It will be appreciated by persons skilled in the art that the present invention is not limited by the drawings and description hereinabove presented. Rather, the invention is defined solely by the claims that follow.

What is claimed is:

1. An improved vortex mill for milling a substantially particulate solid material, said mill including at least one working chamber having a) a side-wall defining a generally cylindrical, inward facing surface;

b) a first end wall and a second end wall arranged transversely to said side-wall and having respective end surfaces formed contiguously with and transversely to said inward-facing surface, thereby to define therewith said at least one working chamber;

c) at least one working fluid inlet for introducing a generally tangential flow of working fluid into said at least one working chamber thereby to create a vortex flow therein;

d) at least one discharge port formed in at least one of said end walls, said at least one working fluid inlet and said at least one discharge port cooperating so as to facilitate a vortex flow of the working fluid introduced via said at least one working fluid inlet, said at least one discharge port permitting discharge of working fluid and milled material from said at least one working chamber;

e) at least one feed inlet disposed in said end wall for introducing a substantially particulate solid material into said at least one working chamber so as to be taken up in a vortex flow of the working fluid, thereby to provide milling of the solid material, milled inlet material being discharged via said at least one discharge port; and f) apparatus for inducing controlled perturbations in the flow of the working fluid in said at least one working chamber, thereby to improve the milling of the solid material in the vortex flow.

2. An improved vortex mill according to claim 1, also includes at least one outer casing configured to surround and enclose said at least one working chamber so as to be spaced therefrom and thereby to define therewith an outer fluid flow volume, and wherein said at least one outer casing includes:

a) at least one outer working fluid inlet for introducing a flow of working fluid into said outer fluid flow volume, thereby to induce a fluid flow therein, operative to discharge through said working fluid inlet into said at least one working chamber;

b) at least one outer feed inlet for introducing substantially particulate solid material into said at least one working chamber via said at least one feed inlet; and c) at least one outer discharge port for permitting discharge of milled particulate solid material from said at least one working chamber via said at least one outer discharge port.

3. An improved vortex mill according to claim 1, wherein said side-wall of said at least one working chamber is formed of at least one functional insert having a closed shape generally coaxially disposed within said working chamber, each said at least one functional insert having a generally cylindrical side-wall formed therein.

4. An improved vortex mill according to claim 3, wherein said at least one functional insert includes at least a first and a second functional insert having substantially similar configurations and a substantially similar angular orientation with respect to each other.

5. An improved vortex mill according to claim 3, wherein said at least one functional insert includes at cast a first and a second functional insert having substantially dissimilar configurations with respect to each other, said dissimilar functional inserts being disposed in a predetermined configuration sequence within said working chamber.

6. An improved vortex mill according to claim 5, wherein said dissimilar functional inserts, are formed having at least one dissimilar parameter selected from the group of parameters, which consists of: diameter, height, shape of said inward facing surface, and mechanical insert elements.

7. An improved vortex mill according to claim 5, wherein said at least one working chamber includes at least one flow restriction element having at least one orifice formed wherein, said at least one orifice having a predetermined size, orientation and disposition, said at least one flow restriction element mounted in a fixed, coaxial disposition relative to said at least one functional insert, thereby to increase dwell time of the particulate solid material to be milled therewithin.

8. An improved vortex mill according to claim 7, wherein said at least one flow restriction element has a configuration selected from the group which consists of; flat, planar, conical, frustum, convex, polyhedral, dished, and a surface generated by rotation of a line about the axis of said chamber in accordance with a predetermined geometric function.

9. Art improved vortex mill according to claim 7, wherein said at least one orifice is formed coaxial with said flow restriction element.

10. An improved vortex mill according to claim 7, wherein said at least one flow restriction element is formed integrally with said at least one working chamber.

11. An improved vortex mill according to claim 7, wherein said flow restriction element is non-fixably supported within said at least one working chamber.

12. An improved vortex mill according to claim 7, wherein said flow restriction element is fixably mounted between a first functional insert and a second functional insert, thereby to control comminution of solid material.

13. An improved vortex mill according to claim 7, wherein said flow restriction element has vanes disposed thereon, thereby to deflect solid particles within the vortex flow generally away from said inward facing surface of said side-wall and generally towards the vortex axis.

14. An improved vortex mill according to claim 7, wherein said flow restriction element has vanes disposed thereon, thereby to deflect solid particles within the vortex flow generally away from the vortex axis and towards said inward facing surface of said side-wall.

15. An improved vortex mill according to claim 7, wherein said flow restriction elements have formed thereon at least one rib-shaped baffle, each of said rib-shaped baffles being concentric with said generally cylindrical side-wall thereby to reduce the velocity of solid particles adjacent to said flow restriction element and thus to prevent premature discharge of the solid particles.

16. An improved vortex mill according to claim 1, wherein said apparatus for inducing controlled perturbations includes at least one of the group which consists of:

a) a side-wall configuration which includes at least one of the group which consists of:
   i) a plurality of substantially planar side-walls;
   ii) at least one working fluid inlet formed within a formed recess located between adjacent said plurality of substantially planar side-walls, said inlet being disposed substantially parallel to said substantially planar side-walls and generally tangentially with respect to said working chamber, and
   iii) at least one auxiliary working fluid inlet formed within at least one of said plurality of substantially planar side-walls, disposed substantially non-parallel to said substantially planar side-walls with respect to said working chamber, said at least one auxiliary working fluid inlet thereby to introduce additional working fluid flow into said working chamber, thereby to cause controlled perturbations in the vortex flow and also thereby to redirect flow of particles away from said planar side-wall across the vortex flow;

b) a side-wall configuration including at least one substantially planar side-wall formed within said generally cylindrical inward facing surface;

c) at least one auxiliary working fluid inlet formed in said side-wall, said at least one auxiliary working fluid inlet directed substantially non-tangentially to said side-wall and at a predetermined angle to the direction of vortex flow at a point of entry of working fluid thereby to enable introduction of additional working fluid flow generally non tangentially into said working chamber, thereby to create controlled perturbations in the vortex flow and also thereby for redirecting the flow of particles away from said side-wall across the vortex flow;

d) at least one mechanical insert element disposed on said inward facing surface, parallel to the axis of said working chamber, said at least one mechanical insert element having a curved surface so as to be generally disposed away from said inward facing surface and towards said working chamber axis, thereby to redirect the flow of working fluid and particles of solid material away from said inward facing surface, and thereby to induce predetermined perturbations in the flow of working fluid; and e) at least one auxiliary working fluid inlet disposed in said inward facing surface, said at least one auxiliary working fluid inlet associated with said at least one mechanical insert element, thereby to redirect flow of working fluid and particles of solid material away from said inward facing surface and thereby to induce predetermined perturbations in the flow of working fluid.

17. An improved vortex mill according to claim 1, wherein said apparatus for inducing predetermined perturbations in the flow of the working fluid includes apparatus selected from the group which consists of:

a) apparatus for controlling the entry flow, rate of working fluid;

b) apparatus for controlling the rate of introduction of substantially particulate solid material into said working chamber;

c) apparatus for varying the working fluid pressure in said working chamber; and d) apparatus for controlling the rate of discharge of particulate solid material.

18. An improved vortex mill according to claim 1, wherein said apparatus for inducing controlled perturbations in the flow of the working fluid is operative to limit the frequency to within the range 5 Hz to $5.10^4$ kHz.

19. An improved vortex mill according to claim 1, wherein each of said end walls has a shape selected from the group which consists of: conical, frustum, convex, polyhedral, dished and a surface generated by rotation of a line about the axis of said chamber in accordance with a predetermined geometric function.

20. An improved vortex mill according to claim 1, wherein said at least one feed inlet has an orientation selected from the group which consists of:

a) disposed in said end wall ca-axial with said working chamber;

b) disposed in said end wall co-axial with said discharge port formed in said working chamber;

disposed in said at least one of said end walls, eccentrically to the axis thereof;

d) disposed co-axially with said discharge port formed in said first end wall, and including a distal end of said at least one feed inlet fixably attached to said inner surface of said second end wall.

21. An improved vortex mill according to claim 1, wherein said at least one feed inlet includes a baffle apparatus generally disposed at a distal end of said feed inlet, said baffle to reduce the kinetic energy of feed particles entering said working chamber through said feed inlet, thereby to reduce feed particle velocity and thereby to diffuse particle flow into said working chamber.

22. An improved vortex mill according to claim 1, wherein said at least one feed inlet communicates with said working chamber via an opening, said opening having a configuration and position which is selected from the group which consists of:

a) a transverse opening in a distal end of said feed inlet;

b) a generally slot-shaped opening in said feed inlet orientated parallel to the axis of said working chamber; and c) a generally slot-shaped opening in said cylindrical feed inlet orientated at a predetermined angle to the axis of said chamber.

23. An improved vortex mill according to claim 1, also includes at least one auxiliary discharge port formed in at least one of said cylindrical side-wall and said end walls.

24. An improved vortex mill according to claim 23, wherein said at least one auxiliary discharge port includes means for discharging partially milled particulate solid material from said at least one auxiliary discharge port and further includes means for receiving discharged partially milled particulate material from said at least one auxiliary discharge port, and for re-introducing the discharged partially milled particulate solid material into said at least one working chamber via a conduit and an auxiliary feed inlet.

25. An improved vortex mill according to claim 24, wherein said auxiliary feed inlet is coaxially formed with said feed inlet.

26. An improved vortex mill according to claim 1, wherein said working chamber has at least one recess formed in at least one of said inward facing surface of said generally cylindrical side-wall, thereby to induce a controlled perturbation in the vortex flow.

27. An improved vortex mill according to claim 26, wherein said at least one recess includes at least one working fluid inlet formed in fluid flow communication with said recess.

28. An improved vortex mill according to claim 26, wherein said at least one recess has at least one portion filled with a fluid permeable diffusing medium, thereby to enable dispersed ingress of working fluid into said working chamber.

29. An improved vortex mill according to claim 1, wherein said at least one working chamber includes a plurality of working chambers arranged to facilitate flow of particulate material there-among, in a predetermined sequence.

30. An improved vortex mill according to claim 29, wherein each of said plurality of working chambers includes at least one discharge port for discharging particulate solid material therefrom and each said at least one discharge port has associated therewith apparatus for receiving discharged material therefrom, and for introducing the discharged material into said feed inlet of a predetermined succeeding working chamber of said plurality of working chambers.

31. An improved vortex mill according to claim 29, wherein at least one of said plurality of working chambers includes at least one auxiliary discharge port formed in at least one of said cylindrical side-wall and said end walls, for discharging therefrom a preselected generally over-sized and partially milled proportion of the discharged particulate solid material and each said auxiliary discharge port has associated therewith apparatus for receiving the preselected proportion of the discharged material therefrom, and for introducing the preselected proportion of discharged material into said feed inlet of a predetermined succeeding working chamber of said plurality of working chambers.

32. A process for milling a substantially particulate solid material using an improved vortex mill, said process including:

a) introducing a generally tangential flow of working fluid into a generally cylindrical working chamber thereby to create a vortex flow therein;

b) feeding substantially particulate solid material sought to be milled into the working chamber through at least one feed inlet disposed in an end wall of the generally cylindrical working chamber, such that the material is taken up in suspension in the vortex flow, thereby to apply comminution stresses to the suspended solid particles;

c) inducing controlled perturbations in the vortex flow, thereby to regulate the comminution stresses applied to the suspended solid particles and thus also the rate of milling thereof; and d) discharging milled particulate solid material together with working fluid from the working chamber.

33. A process according to claim 32, wherein said step of inducing controlled perturbations includes the step of controlling the extent and frequency of the controlled perturbations of the flow of the working fluid, thereby to control the rate of milling of the substantially particulate solid material within the working chamber.

34. A process according to claim 32, and including the additional step of introducing into the working chamber a flow of working fluid via an inlet disposed at a predetermined angle to the direction of flow of the vortex.

35. A process according to claim 32, wherein said step of feeding substantially particulate solid material into the working chamber includes a step of drawing the substantially particulate solid material into the working chamber via an auxiliary feed inlet, such that said step of drawing the substantially particulate solid material into the working chamber is facilitated by a suction effect arising from the vortex flow tangential to the auxiliary feed inlet.

36. A process according to claim 32, wherein said step of discharging particulate solid material includes the step of discharging particulate solid material from one of a plurality of working chambers, and said process also includes the additional step of feeding the discharged particulate solid material into a preselected working chamber of the plurality of working chambers for milling therein.

37. An improved vortex mill for milling a substantially particulate solid material, said mill including at least one working chamber having a) a side-wall defining a generally cylindrical, inward facing surface;

b) a first end wall and a second end wall arranged transversely to said side-wall and having respective end surfaces formed contiguously with and transversely to said inward-facing surface, thereby to define therewith said at least one working chamber;

c) at least one working fluid inlet for introducing a generally tangential flow of working fluid into said at least one working chamber thereby to create a vortex flow therein;

d) at least one discharge port formed in at least one of said end walls, said at least one working fluid inlet and said at least one discharge port cooperating so as to facilitate a vortex flow of the working fluid introduced via said at least one working fluid inlet, said at least one discharge port permitting discharge of working fluid and milled material from said at least one working chamber;

e) at least one feed inlet for introducing a substantially particulate solid material into said at least one working chamber so as to be taken up in a vortex flow of the working fluid, thereby to provide milling of the solid material, milled inlet material being discharged via said at least one discharge port; and f) apparatus for inducing controlled perturbations in the flow of the working fluid in said at least one working chamber, thereby to improve the milling of the solid material in the vortex flow wherein said side-wall of said at least one working chamber is formed of at least one functional insert having a closed shape generally coaxially disposed within said working chamber, each said at least one functional insert having a generally cylindrical side-wall formed therein.

38. An improved vortex mill according to claim 37, also includes at least one outer casing configured to surround and enclose said at least one working chamber so as to be spaced therefrom and thereby to define therewith an outer fluid flow volume, and wherein said at least one outer casing includes:

a) at least one outer working fluid inlet for introducing a flow of working fluid into said outer fluid flow volume, thereby to induce a fluid flow therein, operative to discharge through said working fluid inlet into said at least one working chamber;

b) at least one outer feed inlet for introducing substantially particulate solid material into said at least one working chamber via said at least one feed inlet; and c) at least one outer discharge port for permitting discharge of milled particulate solid material from said at least one working chamber via said at least one outer discharge port.

39. An improved vortex mill according to claim 37, wherein said at least one functional insert includes at least a first and a second functional insert having substantially similar configurations and a substantially similar angular orientation with respect to each other.

40. An improved vortex mill according to claim 37, wherein said at least one functional insert includes at least a first and a second functional insert having substantially dissimilar configurations with respect to each other said dissimilar functional inserts being disposed in a predetermined configuration sequence within said working chamber.

41. An improved vortex mill according to claim 40, wherein said dissimilar functional inserts, are formed having at least one dissimilar parameter selected from the group of parameters, which consists of: diameter, height, shape of said inward facing surface, and mechanical insert elements.

42. An improved vortex mill according to claim 40, wherein said at least one working chamber includes at least one flow restriction element having at least one orifice formed therein, said at least one orifice having a predetermined size, orientation and disposition, said at least one flow restriction element mounted in a fixed, coaxial disposition relative to said at least one functional insert, thereby to increase dwell time of the particulate solid material to be milled therewithin.

43. An improved vortex mill according to claim 42, wherein said at least one flow restriction element has a configuration selected from the group which consists of: flat, planar, conical, frustum, convex, polyhedral, dished, and a surface generated by rotation of a line about the axis of said chamber in accordance with a predetermined geometric function.

44. An improved vortex mill according to claim 42, wherein said at least one orifice is formed coaxial with said flow restriction element.

45. An improved vortex mill according to claim 42, wherein said at least one flow restriction element is formed integrally with said at least one working chamber.

46. An improved vortex mill according to claim 42, wherein said flow restriction element is non-fixably supported within said at least one working chamber.

47. An improved vortex mill according to claim 42, wherein said flow restriction element is fixably mounted between a first functional insert and a second functional insert, thereby to control comminution of solid material.

48. An improved vortex mill according to claim 42, wherein said flow restriction element has vanes disposed thereon, thereby to deflect solid particles within the vortex flow generally away from said inward facing surface of said side-wall and generally towards the vortex axis.

49. An improved vortex mill according to claim 42, wherein said flow restriction element has vanes disposed thereon, thereby to deflect solid particles within the vortex flow generally away from the vortex axis and towards said inward facing surface of said side-wall.

50. An improved vortex mill according to claim 42, wherein said flow restriction elements have formed thereon at least one rib-shaped baffle, each of said rib-shaped baffles being concentric with said generally cylindrical side-wall thereby to reduce the velocity of solid particles adjacent to said flow restriction element and thus to prevent, premature discharge of the solid particles.

51. An improved vortex mill according to claim 37, wherein said apparatus for inducing controlled perturbations includes at least one of the group which consists of:

a) a side-wall configuration which includes at least one of the group which consists of:

i) a plurality of substantially planar side-walls;

ii) at least one working fluid inlet formed within a formed recess located between adjacent said plurality of substantially planar side-walls, said inlet being disposed substantially parallel to said substantially planar side-walls and generally tangentially with respect to said working chamber, and iii) at least one auxiliary working fluid inlet formed within at least one of said plurality of substantially planar side-walls, disposed substantially non-parallel to said substantially planar side-walls with respect to said working chamber, said at least one auxiliary working fluid inlet thereby to introduce additional working fluid flow into said working chamber, thereby to cause controlled perturbations in the vortex flow and also thereby to redirect flow of particles away from said planar side-wall across the vortex flow;

b) a side-wall configuration including at least one substantially planar side-wall formed within said generally cylindrical inward facing surface;

c) at least one auxiliary working fluid inlet formed in said side-wall, said at least one auxiliary working fluid inlet directed substantially non-tangentially to said side-wall and at a predetermined angle to the direction of vortex flow at a point of entry of working fluid thereby to enable introduction of additional working fluid flow generally non tangentially into said working chamber, thereby to create controlled perturbations in the vortex flow and also thereby for redirecting the flow of particles away from said side-wall across the vortex flow;

d) at least one mechanical insert element disposed on said inward facing surface, parallel to the axis of said working chamber, said at least one mechanical insert element having a curved surface so as to be generally disposed away from said inward facing surface and towards said working chamber axis, thereby to redirect the flow of working fluid and particles of solid material away from said inward facing surface, and thereby to induce predetermined perturbations in the flow of working fluid; and e) at least one auxiliary working fluid inlet disposed in said inward facing surface, said at least one auxiliary working fluid inlet associated with said at least one mechanical insert element, thereby to redirect flow of working fluid and particles of solid material away from said inward facing surface and thereby to induce predetermined perturbations in the flow of working fluid.

52. An improved vortex mill according to claim 37, wherein said apparatus for inducing predetermined perturbations in the flow of the working fluid includes apparatus selected from the group which consists of:

a) apparatus for controlling the entry flow rate of working fluid;

b) apparatus for controlling the rate of introduction of substantially particulate solid material into said working chamber;

c) apparatus for varying the working fluid pressure in said working chamber; and d) apparatus for controlling the rate of discharge of particulate solid material.

53. An improved vortex mill according to claim 37, wherein said apparatus for inducing controlled perturbations in the flow of the working fluid is operative to limit the frequency to within the range 5 Hz to $5.10^4$ kHz.

54. An improved vortex mill according to claim 37, wherein each of said end walls has a shape selected from the group which consists of: flat, planar, conical, frustum, convex, polyhedral, dished and a surface generated by rotation of a line about the axis of said chamber in accordance with a predetermined geometric function.

55. An improved vortex mill according to claim 37, wherein said at least one feed inlet has an orientation selected from the group which consists of:

a) disposed in said end wall co-axial with said working chamber;

b) disposed in said end wall co-axial with said discharge port formed in said working chamber;

c) disposed in said at least one of said end walls, eccentrically to the axis thereof;

d) disposed co-axially with said discharge port formed in said first end wall, and including a distal end of said at least one feed inlet fixably attached to said inner surface of said second end wall; and e) disposed in said side-wall.

56. An improved vortex mill according to claim 37, wherein said at least one feed inlet includes a baffle apparatus generally disposed at a distal end of said at least one feed inlet, said baffle to reduce the kinetic energy of feed particles entering said working chamber through said feed inlet, thereby to reduce feed particle velocity and thereby to diffuse particle flow into said working chamber.

57. An improved vortex mill according to claim 37, wherein said at least one feed inlet communicates with said working chamber via an opening, said opening having a configuration and position which is selected from the group which consists of:

a) a transverse opening in a distal end of said feed inlet;

b) a generally slot-shaped opening in said feed inlet orientated parallel to the axis of said working chamber; and c) a generally slot-shaped opening in said cylindrical feed inlet orientated at a predetermined angle to the axis of said chamber.

58. An improved vortex mill according to claim 37, wherein said at least one feed inlet and said at least one discharge port are substantially mutually co-axial.

59. An improved vortex mill according to claim 37, also includes at least one auxiliary discharge port formed in at least one of said cylindrical side-wall and said end walls.

60. An improved vortex mill according to claim 59, wherein said at least one auxiliary discharge port includes means for discharging partially milled particulate solid material from said at least one auxiliary discharge port and further includes means for receiving discharged partially milled particulate material from said at least one auxiliary discharge port, and for re-introducing the discharged partially milled particulate solid material into said at least one working chamber via a conduit and an auxiliary feed inlet.

61. An improved vortex mill according to claim 60, wherein said auxiliary feed inlet is coaxially formed with said feed inlet.

62. An improved vortex mill according to claim 37, wherein said working chamber has at least one recess formed in at least one of said inward facing surface of said generally cylindrical side-wall, thereby to induce a controlled perturbation in the vortex flow.

63. An improved vortex mill according to claim 62, wherein said at least one recess includes at least one working fluid inlet formed in fluid flow communication with said recess.

64. An improved vortex mill according to claim 62, wherein said at least one recess has at least one portion filled with a fluid permeable diffusing medium, thereby to enable dispersed ingress of working fluid into said working chamber.

65. An improved vortex mill according to claim 37, wherein said at least one working chamber includes a plurality of working chambers arranged to facilitate flow of particulate material there-among, in a predetermined sequence.

66. An improved vortex mill according to claim 65, wherein each of said plurality of working chambers includes at least one discharge port for discharging particulate solid material therefrom and each said at least one discharge port has associated therewith apparatus for receiving discharged material therefrom, and for introducing the discharged material into said feed inlet of a predetermined succeeding working chamber of said plurality of working chambers.

67. An improved vortex mill according to claim 65, wherein at least one of said plurality of working chambers includes at least one auxiliary discharge port formed in at least one of said cylindrical side-wall and said end walls, for discharging therefrom a preselected generally over-sized and partially milled proportion of the discharged particulate solid material and each said auxiliary discharge port has associated therewith apparatus for receiving the preselected proportion of the discharged material therefrom, and for introducing the preselected proportion of discharged material into said feed inlet of a predetermined succeeding working chamber of said plurality of working chambers.

* * * * *